US006170822B1

(12) United States Patent
Kato et al.

(10) Patent No.: US 6,170,822 B1
(45) Date of Patent: Jan. 9, 2001

(54) LEAFLETS HANDLING APPARATUS

(75) Inventors: Riichi Kato, Nagoya; Itsunori Utsumi, Owariasahi; Kunihisa Matsuura, Aichi-ken, all of (JP)

(73) Assignee: Hitachi, Ltd., Tokyo (JP)

( * ) Notice: Under 35 U.S.C. 154(b), the term of this patent shall be extended for 0 days.

(21) Appl. No.: 09/166,110

(22) Filed: Oct. 5, 1998

(30) Foreign Application Priority Data

Oct. 6, 1997 (JP) ..... 9-272406
Oct. 6, 1997 (JP) ..... 9-272407

(51) Int. Cl.[7] ..... B65H 39/10

(52) U.S. Cl. ..... 271/298; 271/287; 271/288; 271/297; 271/301; 271/300; 209/534

(58) Field of Search ..... 209/534; 271/287, 271/288, 298, 297, 301, 305, 300, 216

(56) References Cited

U.S. PATENT DOCUMENTS

| | | | | |
|---|---|---|---|---|
| 4,517,451 | * | 5/1985 | Kokubo et al. | 235/379 |
| 4,549,661 | * | 10/1985 | Morishita et al. | 209/534 |
| 4,726,474 | * | 2/1988 | Arikawa et al. | 209/534 |
| 4,889,240 | * | 12/1989 | Sato et al. | 209/534 |
| 4,905,841 | * | 3/1990 | Hirata et al. | 209/534 |
| 5,135,212 | * | 8/1992 | Utsumi et al. | 271/3.1 |
| 5,186,334 | | 2/1993 | Fukudome et al. . | |
| 5,374,814 | * | 12/1994 | Kako et al. | 235/379 |
| 5,735,516 | * | 4/1998 | Gerlier et al. | 270/60 |
| 6,012,564 | * | 1/2000 | Mukai | 194/206 |
| 6,015,147 | * | 1/2000 | Kimura | 271/163 |

FOREIGN PATENT DOCUMENTS

| | | | | |
|---|---|---|---|---|
| 30 22 285 A1 | | 1/1981 | (DE) . | |
| 3414518 A1 | | 6/1985 | (DE) . | |
| 0148310 | * | 7/1985 | (EP) . | |
| 0 148 310 A2 | | 7/1985 | (EP) . | |
| 0 137 537 A2 | | 5/1989 | (EP) . | |
| 0317537 | * | 5/1989 | (EP) | 209/534 |
| 2124005 | * | 2/1984 | (GB) | 209/534 |
| 2 135 977 | | 9/1984 | (GB) . | |
| 0145761 | * | 9/1982 | (JP) | 271/301 |
| 0116462 | * | 5/1987 | (JP) | 209/534 |
| 404107797 | * | 4/1992 | (JP) | 209/534 |
| WO 96/15511 | | 5/1996 | (WO) . | |
| WO 96/26504 | | 8/1996 | (WO) . | |

* cited by examiner

*Primary Examiner*—Donald P. Walsh
*Assistant Examiner*—David A. Jones
(74) *Attorney, Agent, or Firm*—Antonelli, Terry, Stout & Kraus, LLP

(57) ABSTRACT

A paper currency reception/delivery machine having a high degree of general-purpose utility and implemented in a simple structure of a small size at low cost and capable of handling foreign paper currencies of different sizes and other leaflets is imparted selectively with given ones of intelligent functions such as discrimination of denominations, recycling on a denomination-by-denomination basis, replenishment, collection and detailed check and the like. The paper currency reception/delivery machine includes a loop-like paper currency transport path extending in one direction by way of a paper currency checking means, a paper currency reception/delivery port, a temporary custody unit, a delivery-destined paper currency storing unit, a received paper currency storing unit, a recycling-destined paper currency storing unit, a replenishment/collection-destined paper currency storing unit and a rejection-destined paper currency storing unit. Paper currencies can be stored selectively in these units or fed out selectively from these units onto the loop-like paper currency transport path independent of one another through associated branch transport paths.

27 Claims, 10 Drawing Sheets

LEAFLETS HANDLING APPARATUS

BACKGROUND OF THE INVENTION

The present invention generally relates to a leaflets handling apparatus for handling a wide variety of leaflets such as paper sheets, securities or lotteries certificates, account chits, checks, bills and so forth. More particularly, the invention is concerned with a paper currency reception/delivery machine for an automatic cash transaction apparatus (e.g. automatic teller machines or automatic teller machines used in banking facilities, etc.) through which customers or users can perform monetary transactions by using cards, passbooks or the like.

The conventional automatic teller machine installed, for example, in the banking facilities or the like is comprised of a paper currency reception/delivery port through the medium of which the user deposits or receives paper currencies, a paper currency cassette for setting paper currencies, recycle boxes (also known as denomination boxes) provided in a number corresponding to the number of denominations such as ten-thousand yen, thousand yen, etc., for storing the paper currencies received from the user through the paper currency reception/delivery port and feeding out the paper currencies on a denomination-by-denomination basis, and a paper currency check unit, wherein paper currency transport paths 5 are disposed so as to interconnect these units by way of the paper currency check unit, as is disclosed in JP-A-9-44723 (Japanese Unexamined Patent Application Publication No. 44723/1997). Further, there is also known an automatic cash transaction apparatus or automatic teller machine which is comprised of a delivery-destined paper currency storing unit, a received paper currency storing unit, a temporary custody unit and a paper currency reception/delivery port, as disclosed in JP-A-1-163892 (Japanese Unexamined Patent Application Publication No. 160892/1989). Additionally, such an automatic cash transaction apparatus is also known in which a paper currency receiving port for receiving the paper currencies placed by a customer for deposit and a paper currency delivering port for delivering the paper currencies for payment are provided separately from each other, wherein a paper currency reception mechanism constituted by the paper currency receiving port, a paper currency check unit for discriminatively identifying or checking the paper currencies and a received paper currency storing unit on one hand and a paper currency delivery mechanism constituted by the paper currency delivering port and a delivery-destined paper currency storing unit on the other hand are disposed in juxtaposition within the automatic cash transaction apparatus such as the automatic teller machine for performing the money deposit/payment transaction (hereinafter also referred to as the monetary transaction).

As the automatic teller machines or the like automatic cash transaction apparatus become more and more popularized, there arises an increasing need for the paper currency reception/delivery machine which can be implemented at low cost in a smaller size and which can ensure facilitated manipulation as well as the functions and the performances of the conventional machines. On the other hand, with regards to the paper currencies to be handled, there exists a demand for the paper currency reception/delivery machine which can handle not only Japanese yen currencies but also foreign paper currencies in view of the facts that monetary transaction with the foreign paper currencies tend to increase not only in Japan but also in other countries.

By the way, the conventional circulation type paper currency reception/delivery machine designed such that the paper currencies as received from the user for deposit are so recycled as to be delivered for payment is comprised of a paper currency reception/delivery port, recycle boxes provided in a number corresponding to that of the denominations to be handled, a paper currency cassette, a paper currency check unit and a paper currency transport path, wherein the paper currency transport path is realized in a much complicated structure or pattern including many branching paths and merging locations arrayed around the paper currency check unit. Thus, the conventional circulation type paper currency reception/delivery machine suffers problems from the standpoint of the size and the manufacturing costs. Further, this sort of machine is generally so designed as to handle those paper currencies which are in common in respect to the length in the widthwise direction corresponding to the currencies transporting direction regardless of difference in the denomination, as in the case of the paper currencies of Japanese yens. Accordingly, in order to allow the paper currency reception/delivery machine to handle the foreign currencies as well, the recycle box, the paper currency cassettes and the paper currency reception/delivery port have to be modified in conformance with the paper currency sizes. Besides, handling of the paper currencies which differ in the length in the widthwise direction may involve degradation in respect to the positional alignment of the paper currencies stacked within the leaflet storing unit, which in turn may lead to occurrence of double-feed event (i.e., two or more sheets of paper currencies are fed out or delivered in superposed state, which will hereinafter also be referred to as the double-ply state), giving rise to a serious problem in respect to the operation of the paper currency reception/delivery machine.

On the other hand, the paper currency reception/delivery machine of non-circulation type in which the paper currency receiving port for receiving the paper currencies for deposit and the paper currency delivering port for delivering the paper currencies for payment are provided separately and in which the paper currency reception mechanism including the paper currency receiving port, the paper currency check unit and the received paper currency storing unit on one hand and the paper currency delivery mechanism which includes the paper currency delivering port and the delivery-destined paper currency storing unit are disposed in juxtaposition is necessarily of a large size when compared with the circulation type paper currency reception/delivery machine, because the former requires the storing space for the paper currencies, the transport path, the paper currency receiving port, the paper currency delivering port and associated members or units, respectively, for both the mechanisms. Additionally, in the case of the paper currency reception/delivery machine of the non-circulation type, the received paper currencies can not be used straightforwardly as the paper currencies to be delivered for payment, giving rise to a problem that the monetary management efficiency (fund management efficiency) becomes lowered.

BRIEF SUMMARY OF THE INVENTION

In the light of the state of the art described above, it is a first object of the present invention to provide a paper currency reception/delivery machine which can be easily and selectively so reconfigured as to serve as a paper-currency receiving machine only for the deposit transaction or a paper-currency delivering machine only for the payment transaction or a paper currency reception/delivery machine for dealing with both the deposit and payment transactions while allowing a given number of denominations to be selected for the monetary transactions as well as for the recycle of the paper currencies and which can thus cope with a very wide variety of monetary transactions and enjoy high degree of general-purpose utility.

A second object of the present invention is to provide a paper currency reception/delivery machine which can be implemented in a simple structure of a small size at low cost and which can achieve the above-mentioned object.

A third object of the present invention is to provide a paper currency reception/delivery machine which can ensure enhanced manipulatability of safe or storing units for a person in charge of service or maintenance upon occurrence of abnormalities such as jamming of paper currencies, etc..

A fourth object of the present invention is to provide a paper currency reception/delivery machine which is capable of handling not only the paper currencies of Japanese yens but also foreign paper currencies of different sizes.

A fifth object of the present invention is to provide a paper currency reception/delivery machine which can mitigate or reduce significantly a load or burden imposed on a person in charge of service for replenishment of paper currencies, collection and detailed check of the amount in hand when the machine is implemented as a circulation-type paper currency reception/delivery machine of high performance for recycling the received paper currencies as those for delivery.

Parenthetically, it should be understood that a general object of the present invention in its intrinsic sense is to provide a leaflets handling apparatus which can be used or operated as the paper currency reception/delivery machines described above. Needless to say, the paper currency is one species of the leaflets, as mentioned hereinbefore.

In view of the above and other objects which will become apparent as the description proceeds, there is provided according to a general aspect of the present invention a leaflets handling apparatus including a checking unit for checking leaflets and a transport path for transporting leaflets passed through the checking unit, which apparatus further includes a port for receiving or delivering the leaflets, and a plurality of leaflet storing units for storing the leaflets, wherein the transport path includes a main transport path for transporting the leaflets in one direction by way of the checking unit. The leaflets received through the port or the leaflets fed out from the storing units are transferred to the main transport path by way of unit-associated transport paths provided independently and merged to the main transport path, and the leaflets to be fed to the port or the leaflets to be stored in the leaflet storing units individually are collected by tapping from relevant individual branch location(s) provided along the main transport path.

The present invention is also directed to a paper currency reception/delivery machine which includes a paper currency receiving port for receiving paper currencies placed by user for deposit, a paper currency delivering port for delivering paper currencies to the user for payment, a paper currency check unit for checking discriminatively the paper currencies and a paper currency transport path for transporting the paper currencies by way of the paper currency check unit. The paper currency reception/delivery machine according to an aspect of the invention further includes a temporary custody unit for storing or retaining once the received paper currencies, a received paper currency storing unit for storing the received paper currencies, a delivery-destined paper currency storing unit for storing and feeding out paper currencies to be delivered from the paper currency reception/delivery machine for payment, a recycling-destined paper currency storing unit for storing the received paper currencies to be recycled for delivery upon payment, a rejection-destined paper currency storing unit for storing the paper currencies not to be stored in the received paper currency storing unit and the paper currencies fed out from the delivery-destined paper currency storing unit and not to be delivered for payment, and a replenishment/collection-destined paper currency storing unit for feeding out paper currencies for replenishing the recycling-destined paper currency storing unit and storing the paper currencies collected or recovered from the recycling-destined paper currency storing unit. The storing units mentioned above are disposed in an arbitrarily selected and combined array. Further, a loop-like main paper currency transport path extending in one direction by way of the paper currency check unit is provided, wherein the paper currencies fed out from the paper currency receiving port, the temporary custody unit, the delivery-destined paper currency storing unit, the recycling-destined paper currency storing unit and the replenishment/collection-destined paper currency storing unit, respectively, are transferred onto the main paper currency transport path, while the paper currencies to be placed or stored in the paper currency delivering port, the temporary custody unit, the received paper currency storing unit, the recycling-destined paper currency storing unit, the rejection-destined paper currency storing unit and the replenishment/collection-destined paper currency storing unit, respectively, are transferred from the main paper currency transport path to associated branch transport paths branched from the main paper currency transport path.

According to still another aspect of the present invention, there is provided a paper currency reception/delivery machine of the structure described above in which the temporary custody unit, the delivery-destined paper currency storing unit, the received paper currency storing unit, the recycling-destined paper currency storing unit, the rejection-destined paper currency storing unit and the replenishment/collection-destined paper currency storing unit are disposed sequentially in an arbitrarily selectable combination at appropriate locations downstream of the paper currency check unit relative to the loop-like paper currency transport path extending in one direction, wherein the above-mentioned arbitrarily selectable combination is followed by a combination of the paper currency delivering port and the paper currency receiving port and wherein the individual units and ports mentioned above are connected to the main paper currency transport path so as to merge thereto or branch therefrom.

According to a further aspect of the present invention, there is provided a paper currency reception/delivery machine of the structure described above in which the temporary custody unit, a combination of the paper currency delivering port and the paper currency receiving port, and an arbitrarily selectable combination of the delivery destined paper currency storing unit, the received paper currency storing unit, the recycling-destined paper currency storing unit, the rejection-destined paper currency storing unit and the replenishment/collection-destined paper currency storing unit are disposed sequentially in this order relative to the loop-like paper currency transport path, wherein the individual units and ports mentioned above are connected to the main paper currency transport path so as to merge thereto or branch herefrom.

A yet further aspect of the present invention is directed to a paper currency reception/delivery machine which includes a paper currency receiving port for receiving paper currencies placed by user for deposit, a paper currency delivering port for delivering paper currencies to the user for payment, a paper currency check unit for checking discriminatively the paper currencies and a paper currency transport path for transporting the paper currencies by way of the paper currency check unit. In the paper currency reception/delivery machine of the structure described above, it is proposed according to the present invention to provide a recycling-destined paper currency storing unit for storing and delivering the received paper currencies as the delivery-destined paper currencies, a rejection-destined paper currency storing unit for storing the received paper currencies not to be stored in the received paper currency storing unit and the paper currencies not to be delivered from the delivery-destined paper currency storing unit, and a replenishment/collection-destined paper currency storing unit for feeding out the paper currencies to replenish the recycling-destined paper currency storing unit while storing the paper currencies collected from the recycling-destined paper currency storing unit, wherein the recycling-destined paper currency storing unit and the replenishment/collection-destined paper currency storing unit are implemented mutually exchangeably and mounted removably.

The above and other objects, features and attendant advantages of the present invention will more easily be understood by reading the following description of the preferred embodiments thereof taken, only by way of example, in conjunction with the accompanying drawings.

BRIEF DESCRIPTION OF THE SEVERAL VIEWS OF THE DRAWINGS

In the course of the description which follows, reference is made to the drawings, in which.

DETAILED DESCRIPTION OF THE INVENTION

Figure 1:
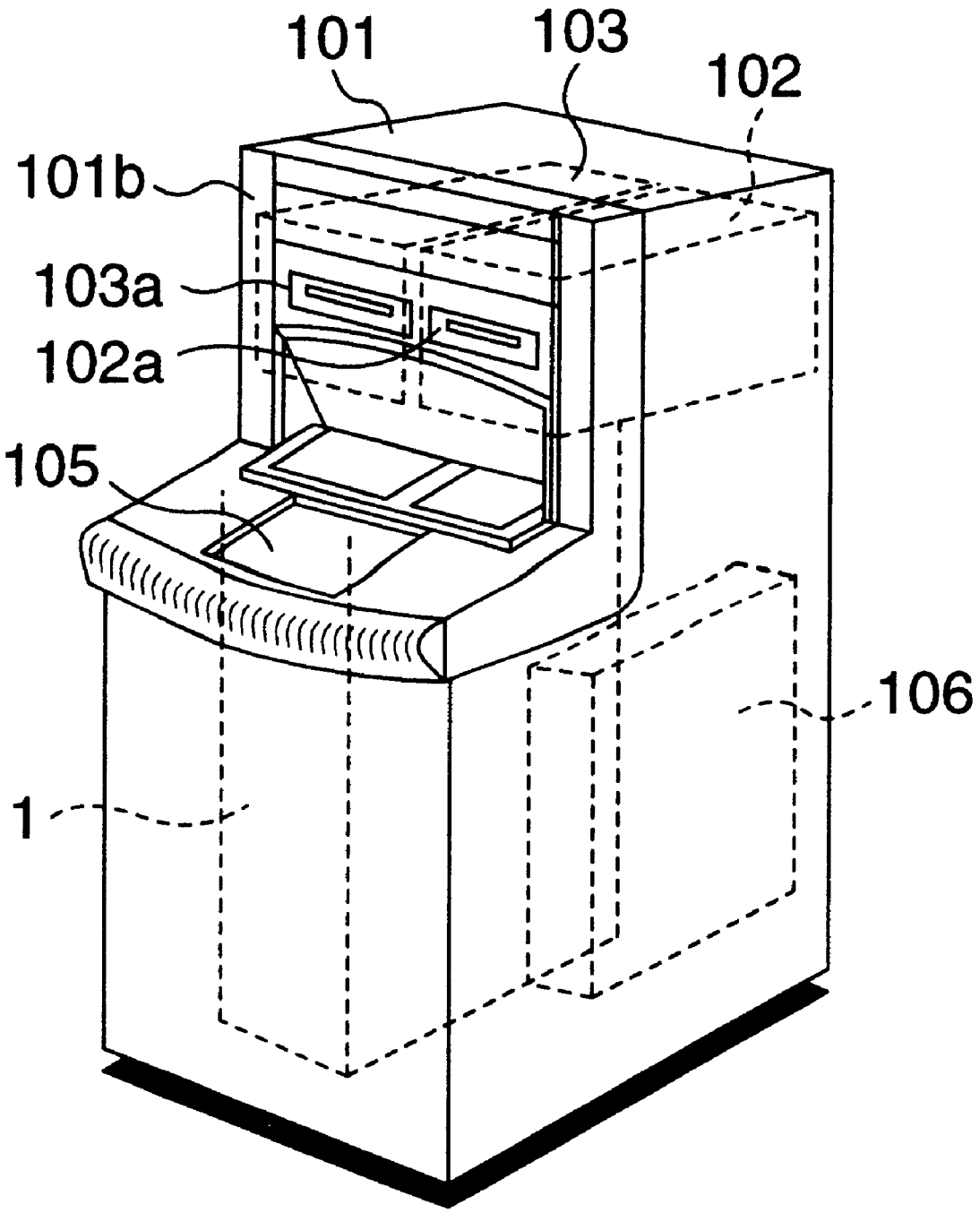
FIG. 1 is a perspective view showing an outer appearance of an automatic cash transaction apparatus according to an embodiment of the present invention.

The present invention will be described in detail in conjunction with what is presently considered as preferred or typical embodiments thereof by reference to the drawings. In the following description, like reference characters designate like or corresponding parts throughout the several views. Also in the following description, it is to be understood that such terms as "front", "rear", "left", "right", "top", "bottom", "vertical", "horizontal", "clockwise", "counterclockwise" and the like are words of convenience and are not to be construed as limiting terms.

Embodiment 1

Now, description will be made of a leaflets handling apparatus according to a first embodiment of the present invention by reference to the drawings. The following description is directed to a paper currency receiving/delivering machine or mechanism incorporated in an automatic cash transaction apparatus for handling the paper currencies as a typical or exemplary one of the leaflets handling apparatus. However, this is only for convenience of the description. With the term "leaflets", it is intended to encompass not only the paper currencies but also other types of paper sheets or bills such as securities, lotteries, tickets, chits, checks, thin cards and so fourth.

FIG. 1 is a perspective view showing an outer appearance of an automatic cash transaction apparatus which incorporates a paper currency reception/delivery mechanism or machine according to an embodiment of the present invention.

Referring to FIG. 1, reference numeral 101 denotes generally a housing main body which accommodates therein a card/account-chit handling mechanism 102 and a passbook handling mechanism 103 at an upper portion thereof. The card/account-chit handling mechanism 102 is operatively communicated to a card slot 102*a* provided in an upper front plate 101*b* of the housing main body 101 and so designed as to process information/data carried by a user's card inserted through the card slot 102*a* to thereby deliver a printed transaction account chit. On the other hand, the passbook handling mechanism 103 is operatively communicated to a passbook slot 103*a* and designed for handling a user's passbook inserted through the passbook slot 103*a*. Reference numeral 1 denotes generally the paper currency reception/delivery mechanism or machine for handling the paper currencies. As can be seen in the figure, this machine is disposed within the housing main body 101 at a lower portion thereof. A customer-dedicated operating unit 105 is installed at an intermediate portion of the housing main body 101 for displaying contents of monetary transaction while allowing the user or customer to input information/data for the transaction. Reference numeral 106 denotes an integrative control unit which is in charge of controlling operations of the automatic cash transaction apparatus as a whole.

Figure 2:
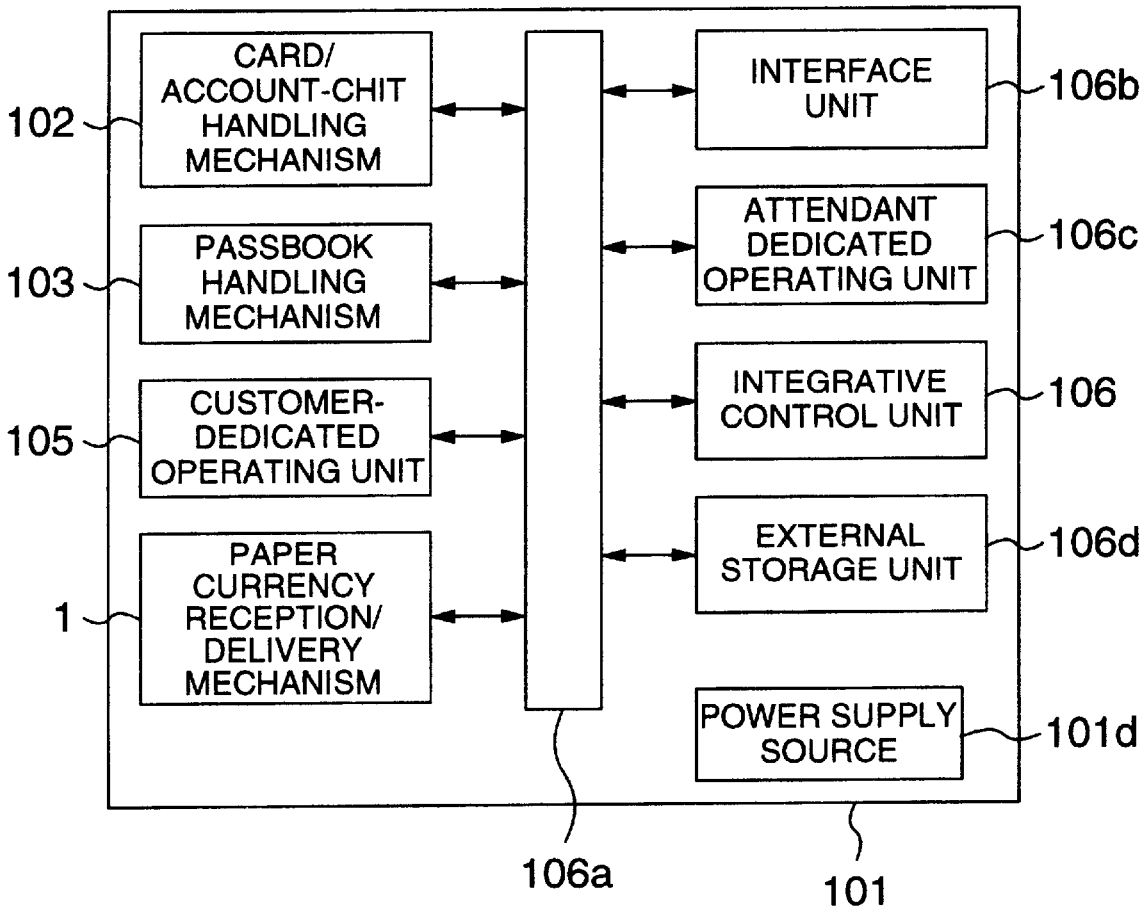
FIG. 2 is a functional block diagram for illustrating generally and schematically control scheme adopted in the automatic cash transaction apparatus.

FIG. 2 is a functional block diagram for illustrating generally and schematically control or functional relations in the automatic cash transaction apparatus. The card/account-chit handling mechanism 102, the passbook handling mechanism 103, the paper currency reception/delivery machine 1 and the customer-dedicated operating unit 105 accommodated or installed in the housing main body 101, as described above, are electrically connected to the integrative control unit 106 by way of a bus 106*a* for carrying out respective operations under the control of the integrative control unit 106. In addition, an interface unit 106*b*, an attendant-dedicated operating unit 106*c* and an external storage unit 106*d* are connected to the integrative control unit 106 by way of the bus 106*a* for realizing data transactions as required. In FIG. 2, reference character 101*d* denotes a power supply source for supplying electric energy to the individual mechanisms and units mentioned above.

Figure 3:
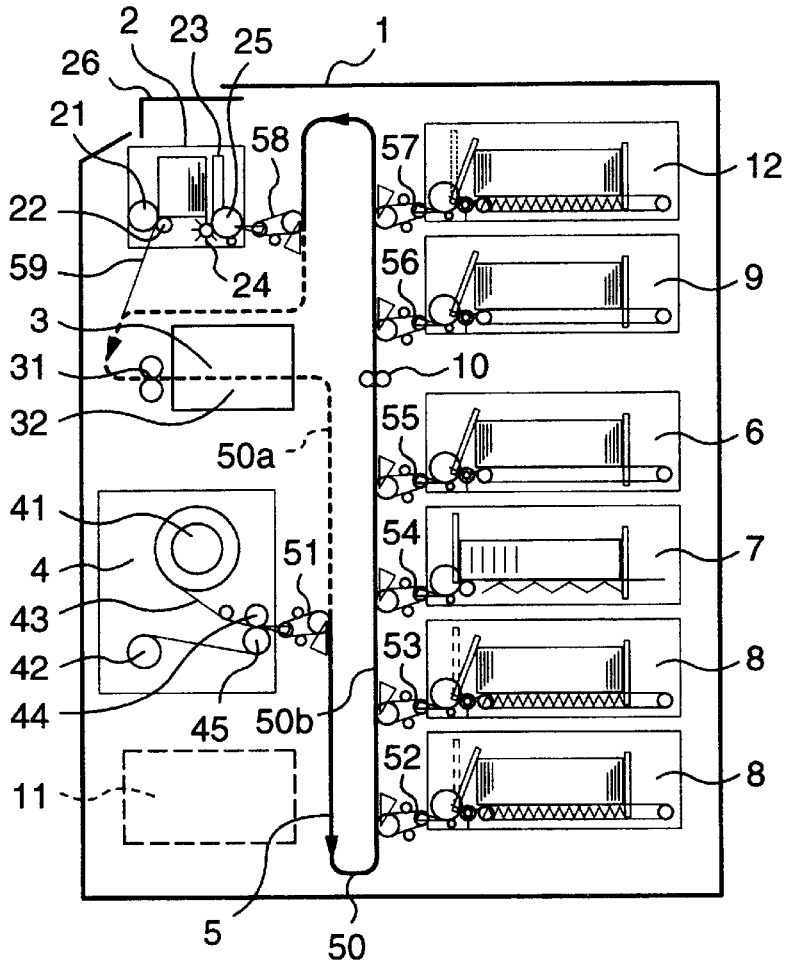
FIG. 3 is a schematic side elevational view showing schematically an internal structure of a paper currency reception/delivery machine which can be incorporated in the automatic cash transaction apparatus according to a first embodiment of the present invention.

FIG. 3 is a schematic side elevational view showing an internal structure of the paper currency reception/delivery machine 1 according to the instant embodiment of the invention which is incorporated in the automatic cash transaction apparatus shown in FIG. 1.

Referring to FIG. 3, the paper currency reception/delivery machine 1 includes a paper currency reception/delivery port 2 through which the paper currencies placed by the user for deposit are received by the machine or through which the paper currencies demanded by the user for withdrawal from the deposit are delivered, a received paper currency check unit 3 disposed at a location downstream of the paper currency reception/delivery port 2 for performing discriminative check or identification of the paper currencies inserted through the paper currency reception/delivery port 2, and a temporary custody unit 4 disposed at a location downstream of the received paper currency check unit 3 as viewed in the direction in which the paper currencies inserted or loaded are fed. This temporary custody unit 4 serves for holding or retaining the paper currencies temporarily until the relevant monetary transaction has been completed. Further, the paper currency reception/delivery machine 1 includes a received paper currency storing unit 6 for storing therein the paper currencies upon completion or conclusion of the transaction for deposit, a delivery-destined paper currency storing unit 7 for storing paper currencies to be delivered for payment, two recycling-destined paper currency storing units 8 each of which is designed to serve for both the reception and the delivery of the paper currencies, and a rejection-destined paper currency storing unit 9 for storing or accommodating therein the received paper currencies not to be stored in the received paper currency storing unit 6 and the paper currencies fed out from the delivery-destined paper currency storing unit 7 and not to be used for the delivery. To say in another way, the rejection-destined paper currency storing unit 9 serves for storing those paper currencies which can not be discriminatively identified by a check unit mentioned below. More specifically, upon delivery of paper currencies for payment, the paper currencies are checked by a delivery-destined paper currency check unit 10. The rejection-destined paper currency storing unit 9 stores the paper currencies rejected by this check unit 10. By contrast, the paper currencies rejected upon reception for deposit are fed back to the paper currency reception/delivery port 2 without being stored in the rejection-destined paper currency storing unit 9. Furthermore, the paper currency reception/delivery machine 1 includes a replenishment/collection-destined paper currency storing unit 12 for storing the paper currencies destined for replenishing the recycling-destined paper currency storing unit 8 or the paper currencies collected or recovered from the recycling-destined paper currency storing unit 8. The delivery destined paper currency check unit 10 mentioned above is designed to check or discriminatively identify the paper currencies upon delivery thereof for payment. At this juncture, it should be mentioned that the delivery-destined paper currency check unit 10 is designed to check or discriminate primarily the paper currencies delivered from the delivery-destined paper currency storing unit 7 and the recycling-destined paper currency storing unit 8. On the other hand, in the delivery-destined paper currency storing unit 7, paper currencies are previously placed manually by a worker of the banking facilities, while in the recycling-destined paper currency storing unit 8, the paper currencies checked previously by the received paper currency check unit 3 are placed. Accordingly, the paper currency check performed by the delivery-destined paper currency check unit 10 is relatively simple when compared with that of the received paper currency check unit 3. In practical applications, the delivery-destined paper currency check unit 10 may be so implemented as to be capable of detecting double- or more-ply state of the paper currencies, which in turn means that the delivery-destined paper currency check unit 10 can be realized in a simple structure as compared with the check unit 3.

The paper currency reception/delivery machine 1 further includes a paper currency transport path 5 which extends from the paper currency reception/delivery port 2 through the received paper currency check unit 3 and along the temporary custody unit 4, the recycling-destined paper currency storing unit 8, the delivery-destined paper currency storing unit 7, the received paper currency storing unit 6, the delivery-destined paper currency check unit 10, the rejection-destined paper currency storing unit 9 and the replenishment/collection-destined paper currency storing unit 12 back to the paper currency reception/delivery port 2. At this juncture, it should be mentioned that the paper currency transport path 5 details of which will be described later on is comprised of a main transport path implemented in a circular or loop-like configuration and branch transport paths for communicating the main transport path with a plurality of units such as the recycling-destined paper currency storing units 8, the delivery-destined paper currency storing unit 7 and others for storing the paper currencies in these units. With the structure described above, there can be realized the paper currency receiving/delivering machine or apparatus of a simple and inexpensive structure.

Further, the paper currency reception/delivery machine 1 includes a controller unit 11. This controller unit 11 responds to the commands issued by the integrative control unit 106 described hereinbefore in conjunction with FIGS. 1 and 2 and the signals indicating the detected states of the paper currency reception/delivery machine 1 to thereby control correspondingly the operations of the paper currency reception/delivery machine 1. In addition, the controller unit 11 also serves to send the state information of the paper currency reception/delivery machine 1 to the integrative control unit 106, as occasion requires. At this juncture, it is to be mentioned that the paper currency transport path 5 which is shown schematically as a line is provided with branching points each equipped with a switching gate, wherein the paper currencies are transported in one direction indicated by arrows. The transportation of the paper currencies is controlled by the controller unit 11 on the basis of the results of the checks performed by the received paper currency check unit 3 and the delivery-destined paper currency check unit 10. By virtue of the arrangement described above, there arises no necessity of transporting the paper currencies selectively in the upstream or down stream direction. In other words, transportation of the paper currencies is controlled only in one direction. Thus, there can be realized the paper currency reception/delivery machine and hence the automatic cash transaction apparatus at low cost in a much simplified structure.

Next, referring to FIGS. 3 to 8, description will be made in detail of the structures and operations of the major components of the paper currency reception/delivery machine according to the instant embodiment of the invention.

The paper currency reception/delivery port 2 is provided with a shutter 26 which can be slideably opened and closed. In the state where the shutter 26 is opened, the user can withdraw or take out paper currencies from the paper currency reception/delivery port 2 upon payment or the user can place or load the paper currencies in the paper currency reception/delivery port 2 for deposit. The paper currencies as loaded or charged through the paper currency reception/delivery port 2 are pressed against a feed roller 21 by means of a presser bar 23, whereby the paper currencies are fed into the machine sheet by sheet under the action of rotation of the feed roller 21, while the paper currencies are prevented from being fed in the double-ply state by means of a gate roller 22 which is disabled to rotate in the delivering direction. In this manner, the paper currencies placed in the paper currency reception/delivery port 2 is fed to the paper currency transport path 5 to be accommodated within the paper currency reception/delivery machine. On the other hand, the paper currencies delivered out from the paper currency reception/delivery machine as well as the paper currencies rejected for the reason of incapability of discrimination of the paper currencies upon deposit is fed to between a stack roller 25 and a brush roller 24 disposed within the paper currency reception/delivery port 2 along the paper currency transport path 5. Thus, the paper currencies transported successively are prevented from interfering with one another, which allows the user to take out the paper currencies with ease.

The received paper currency check unit 3 includes a pair of rollers, a double-ply detector (or overlap detector) 31 for detecting the double-ply state of the paper currencies on the basis of inter-roller displacement upon transportation of the paper currencies between these rollers, and a discriminator 32 for detecting printed information or data of the paper currency with the aid of an image sensor or the like to thereby determine denomination as well as authenticity of the paper currency, wherein the results of the discrimination of the paper currencies passed through the received paper currency check unit 3 are messaged to the controller unit 11.

The temporary custody unit 4 includes a guide tape 43 made of stainless thin plate or strap, a rotatable drum 41 for taking up the paper currencies transported together with the guide tape 43, a take-up shaft 42 for taking up only the guide tape 43, an entrance roller 45 which is rotatable together with the guide tape 43 and which serves for guiding the movement of the paper currency toward the rotatable drum 41, and a backup roller 44 disposed in opposition to the entrance roller 45. The rotatable drum 41 and the take-up shaft 42 supporting, respectively, both end portions of the guide tape 43 are operatively coupled to driving sources (not shown) provided separately in association with the rotatable drum 41 and the take-up shaft 42, respectively, wherein a torque limiter is interposed between the take-up shaft 42 and the associated driving source. Before the money reception or deposit transaction is effectuated, the guide tape 43 is wound substantially completely around the take-up shaft 42. When the received paper currencies are to be stored in the temporary custody unit 4, the rotatable drum 41 is rotated in the direction (clockwise direction) for taking up the guide tape 43 such that the running speed of the guide tape 43 is substantially equal to the moving speed of the paper currency, whereby the received paper currencies are successively wound around the rotatable drum 41. On the other hand, the take-up shaft 42 is driven by the associated driving source by way of the torque limiter in the direction for taking up the guide tape 43, i.e., in the direction for applying a tension to the guide tape 43. Thus,the guide tape 43 can be taken up by the rotatable drum 41 together with the paper currencies without being accompanied with any appreciable sagging. At this junction, it is to be noted that the paper currencies taken up by the rotatable drum 41 have already undergone discriminative check concerning the denomination and other respects and that the controller unit 11 stores the denomination information of the paper currencies on a one-by-one basis while monitoring the movement of the paper currencies into the temporary custody unit 4. Upon successful completion of the deposit transaction for the paper currencies accommodated within the temporary custody unit 4, i.e., upon completion or conclusion of the transaction processing as to the coincidence between the paper currencies received from the user and the paper currencies discriminatively identified by the paper currency reception/delivery machine, the rotatable drum 41 is rotated in the direction reverse to the direction mentioned previously (i.e., the rotatable drum 41 is rotated in the counter-clockwise direction, as illustrated), whereby the paper currencies taken up under tension by the take-up shaft 42 in the take-up direction by the take-up shaft 42 by way of the torque limiter under tension are sent out or delivered successively to the paper currency transport path 5 in the order reverse to the storing operation.

Figure 4:
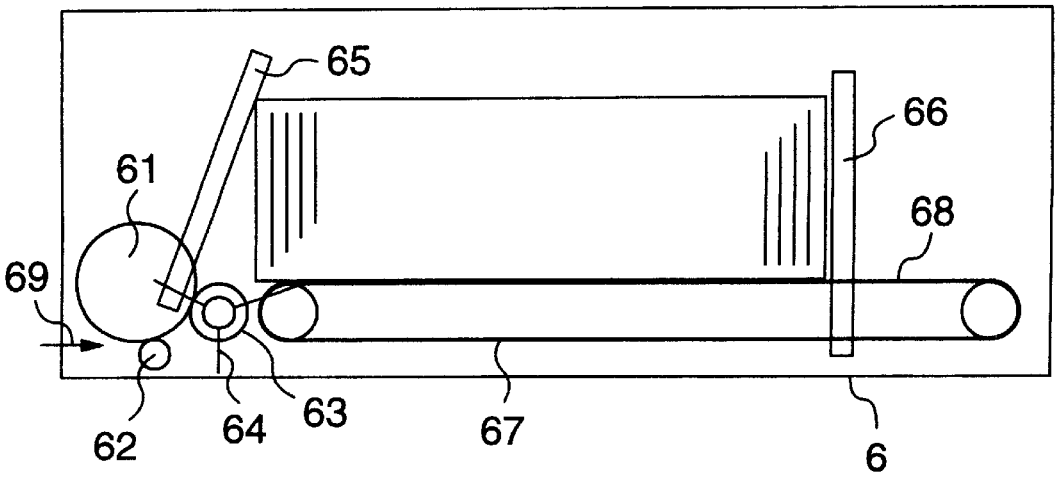
FIG. 4 is a side elevational view showing a structure of a received paper currency storing unit incorporated in the paper currency reception/delivery machine shown in FIG. 3.

In the case of the paper currency reception/delivery machine according to the embodiment of the invention shown in FIG. 3, only one received paper currency storing unit 6 is employed. As can be seen in FIG. 4, the received paper currency storing unit 6 is comprised of a rotatable stack roller 61 driven through a gear train by a driving source (not shown) provided externally of the received paper currency storing unit 6, backup rollers 62 and 63 mounted in opposition to the stack roller 61, a brush roller 64 disposed coaxially with the backup roller 63 and having elastic thin members extending radially outwardly, and a stacking guide 65. The stack roller 61, the backup rollers 62 and 63, the brush roller 64 and the stacking guide 65 cooperate to constitute a stacking mechanism. The paper currencies transported toward the received paper currency storing unit 6 from the paper currency transport path 5 shown in FIG. 3 in the direction indicated by an arrow 69 are caused to move under the action of rotation of the stack roller 61 while being pressed against the stacking guide 65 by rotating the brush roller 64, whereby the paper currency stack is urged in the direction away from the stacking guide 65. Thus, the paper currencies can be stored without mutual interference. Further, the paper currencies as accommodated are stored within a storing space defined as enclosed by a bottom plate 68, a presser bar 66, a bottom belt 67 suspended above the bottom plate 68 with a distance therefrom for supporting the paper currencies stacked at the bottom and the stacking guide 65. The presser bar 66 and the bottom belt 67 are adapted to move within the storing space in unison being urged rightwards as viewed in the figure under the driving efforts of the associated driving source (not shown) and move the stored paper currency away from the stacking guide 65 while preventing the paper currencies going to enter the storing unit and the stored paper currencies from interfering with each other. Owing to the arrangement described above, the paper currencies transported by the stacking mechanism can be stored within the received paper currency storing unit 6 without interfering the paper currencies already stored notwithstanding of the fact that the received paper currency storing unit 6 is of lateral disposition or lying type.

Figure 5:
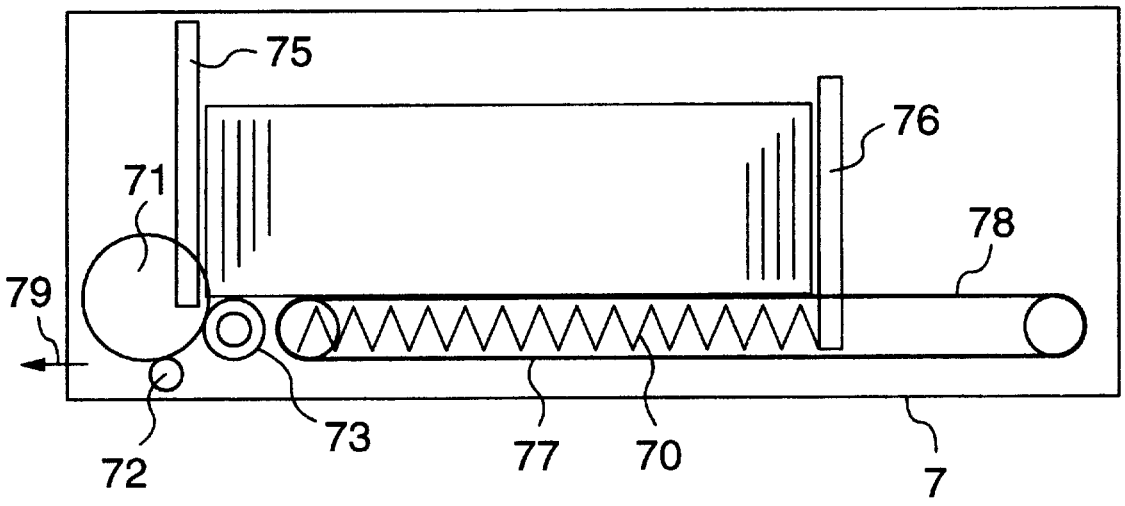
FIG. 5 is a side elevational view showing a structure of a delivery-destined paper currency storing unit incorporated in the paper currency reception/delivery machine shown in FIG. 3.

In the case of the paper currency reception/delivery machine according to the embodiment of the invention shown in FIG. 3, one delivery-destined paper currency storing unit 7 is employed. As can be seen in FIG. 5, the delivery-destined paper currency storing unit 7 is comprised of a feed roller 71 driven through a gear train by a driving source (not shown) provided externally of the delivery-destined paper currency storing unit 7, a backup roller 72 mounted to be driven in opposition to the feed roller 71, a gate roller 73 disposed in opposition to the feed roller 71 and not driven in the direction for feeding the paper currencies, and a separating guide 75. The paper currencies destined for delivery are placed in the aligned state by a person in charge of service within a storing space defined as enclosed by a bottom plate 78, a presser bar 76, a bottom belt 77 suspended above the bottom plate 78 with a distance therefrom for supporting the paper currencies stacked at the bottom and the separating guide 75, wherein the leftmost paper currency which is nearest to the feed roller 71 as viewed in the drawing is pressed against a feed roller 71 leftwards by means of an interposed presser bar spring 70. The presser bar 76 and the bottom belt 77 can move in unison within the storing space. As the number of the paper currencies decreases, the stored paper currency stack is so moved that a predetermined pressing force is applied to the paper currency being fed by the feed roller 71. Thus, the paper currencies pressed against the feed roller 71 are fed outwardly by means of the rotating feed roller 71, whereby the paper currencies are transferred on a sheet-by-sheet basis to the paper currency transport path 5 shown in FIG. 3 from the delivery-destined paper currency storing unit 7 in the direction indicated by an arrow 79.

Figure 6:
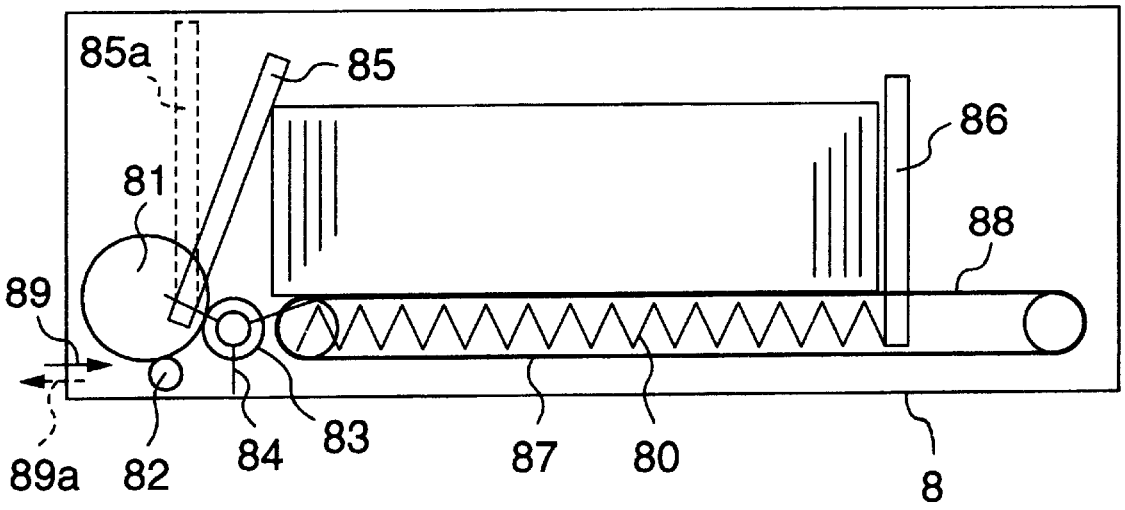
FIG. 6 is a side elevational view showing a structure of a recycling-destined paper currency storing unit shown in FIG. 3.

FIG. 6 is a diagram showing in detail a structure of the recycling-destined paper currency storing unit 8 shown in FIG. 3. In the case of the paper currency reception/delivery machine according to the instant embodiment of the invention, it is presumed that two recycling-destined paper currency storing units 8 are installed. The recycling-destined paper currency storing unit 8 is designed to serve for two functions, i.e., the function of the received paper currency storing unit 6 for storing successively the paper currencies and the function of the delivery-destined paper currency storing unit 7 for delivering the paper currencies separately and successively. In other words, the recycling-destined paper currency storing unit 8 is a storing unit or a safe unit which is capable of accommodating the paper currencies and delivering them separately. To this end, the recycling-destined paper currency storing unit 8 includes a stacking/separating mechanism of a substantially same structure as that of the delivery-destined paper currency storing unit 7 described previously. More specifically, the stacking/separating mechanism of the recycling-destined paper currency storing unit 8 is comprised of a stacking feed roller 81, a rotatable backup roller 82, a gate roller 83 capable of rotating in the paper currency stacking direction and inhibited from rotating in the delivering direction, a brush roller 84 disposed coaxially with the gate roller 83 and having elastic thin members extending radially outwardly and a separating/stacking guide 85 adapted to operate upon separation and stacking of the paper currencies. The paper currencies are stored within the storing space which is defined as surrounded by a bottom plate 88, a presser bar 86, a bottom belt 87 set over the bottom plate 88 so as to support the bottom ends of the paper currencies and the separating/stacking guide 85. Upon paper currency separating operation for feeding out the paper currencies from the recycling-destined paper currency storing unit 8, the separating/stacking guide 85 is moved to a position indicated by a broken line 85*a*, while the presser bar 86 and the bottom belt 87 move in unison within the storing space (rightwardly as viewed in the figure) to thereby move the stored paper currencies such that the paper currencies as delivered are caused to bear against the stacking feed roller 81 under a predetermined pressure exerted by the presser bar spring 80. The paper currencies pressed against the stacking feed roller 81 are delivered or fed out under the action of the rotation of the stacking feed roller 81. At that time, the paper currencies are prevented form being superposed one another, for example, in the double-ply state. Thus, the paper currencies can be delivered one by one in the direction indicated by an arrow 89*a*. On the other hand, upon paper currencies stacking operation for feeding the paper currencies into the recycling-destined paper currency storing unit 8, the separating/stacking guide 85 is moved to a position indicated by a solid line 85, while the presser bar 86 and the bottom belt 87 are caused to move in unison within the storing space (rightwardly as viewed in the figure) by a driving source (not shown) provided externally of the storing unit, whereby the stored paper currencies are controllably moved in the direction away from the separating/stacking guide 85 so that the entering paper currencies transported currently in the direction indicated by an arrow 89 do not interfere with the stored paper currencies.

The rejection-destined paper currency storing unit 9 shown in FIG. 3 has an internal structure which is implemented substantially similarly to the received paper currency storing unit 6 described previously and serves to store or accommodate the paper currencies delivered primarily from the recycling-destined paper currency storing unit 8 and/or the delivery-destined paper currency storing unit 7 and rejected by the delivery-destined paper currency check unit 10.

The replenishment/collection-destined paper currency storing unit 12 is so designed as to serve for both functions for separately or discretely transporting the paper currencies for replenishing to the recycling-destined paper currency storing unit 8 with paper currencies and collecting the paper currencies from the recycling-destined paper currency storing unit 8. To this end, the internal structure of the replenishment/collection-destined paper currency storing unit 12 is implemented essentially similarly to that of the recycling-destined paper currency storing unit 8 described hereinbefore.

As will now be appreciated from the foregoing, the individual component units of the paper currency reception/ delivery machine can be classified into a first unit group dedicated for stacking the paper currencies such as the received paper currency storing unit 6 and the rejection-destined paper currency storing unit 9, a second unit group designed for paper currency separation such as the delivery-destined paper currency storing unit 7, and a third unit group designed to serve for both the stacking function and the separating function such as the recycling-destined paper currency storing unit 8 and the replenishment/collection-destined paper currency storing unit 12. Although the units belonging to the different unit groups have respective internal structures differing one another, they can be implemented substantially in a same geometrical configuration (e.g. box-like) with substantially same outer dimensions or sizes. Thus, in the case of the paper currency reception/delivery machine according to the instant embodiment of the invention, the individual units mentioned above can be easily exchanged mutually and correspondently in dependence on the denominations and/or practical applications of the paper currency reception/delivery machine.

At this juncture, it should be added that the delivery-destined paper currency check unit 10 which is designed to check the paper currency fed out from the delivery-destined paper currency storing unit 7 or the rejection-destined paper currency storing unit 9 upon delivery transaction, as mentioned hereinbefore, may be implemented in a simple structure capable of checking at least the double-ply state of the paper currencies because the paper currencies contained in the delivery-destined paper currency storing unit 7 and the recycling-destined paper currency storing unit 8 are classified groupwise on a denomination-by-denomination basis, rendering it unnecessary to check the denomination and the authenticity of the paper currencies. Thus, in the case of the paper currency reception/delivery machine according to the instant embodiment of the invention, the delivery-destined paper currency check unit 10 may be constituted by a pair of rollers in a manner similar to the double-ply detector 31 of the received paper currency check unit 3 described hereinbefore. In that case, detection of the double-ply state of the paper currencies can equally be realized by detecting the displacement of the rollers taking place when the paper currency is being transported between the rollers.

As can be seen in FIG. 3, the paper currency transport path 5 includes a main transport path 50 (also referred to as the major transport path) which extends in one direction through or by way of the received paper currency check unit 3 and the delivery-destined paper currency check unit 10 and in the vicinity of the individual units in a loop-like fashion and unit transport paths 51 to 59 (also referred to as the branch transport paths) which branch from the main transport path 50 at local portions thereof for enabling the transportation of the paper currencies for storage or delivery relative to the temporary custody unit 4, the recycling-destined paper currency storing unit 8, the delivery-destined paper currency storing unit 7, the received paper currency storing unit 6, the rejection-destined paper currency storing unit 9, the replenishment/collection-destined paper currency storing unit 12 and the paper currency reception/delivery port 2.

Now, description will turn to features concerning the relations among the main transport path 50, the unit or branch transport paths 51 to 52 and the individual units.

Referring to FIG. 3, the main transport path 50 is implemented in a closed-loop-like configuration such that a paper currency can be transported from a given location in one direction to move back to the given location mentioned above without passing repetitively any same location. In other words, transportation of the paper currencies is carried out in a closed-loop-like fashion. On the other hand, the individual units, i.e., a plurality of storing units storing the paper currencies are disposed serially or sequentially along the main transport path 50, while the unit or branch transport paths 51 to 59 interconnecting the individual units and the main transport path 50 are adapted to transfer the paper currencies with the main transport path 50 independent of one another. By virtue of this arrangement, the transport paths and the individual units can be designed easily and simply, which in turn means that the paper currency receiving/delivering apparatus can be realized very inexpensively.

The main transport path 50 can be divided into an upstream main transport path 50*a* which extends from the paper currency reception/delivery port 2 to the branching point for the temporary custody unit 4 by way of the received paper currency check unit 3, as indicated by a thick broken line, and a downstream main transport path 50*b* extending from the branching point for the temporary custody unit 4 back to the paper currency reception/delivery port 2 by way of the delivery-destined paper currency check unit 10.

In the following, description will be made in detail concerning the control of the transportation of the paper currencies along the main or major transport path 50.

The upstream main transport path 50*a* constituting a part of the main transport path 50 is put into operation by electrically energizing a first driving motor (not shown) to relate it in one direction, whereby transportation of the paper currencies can be realized. Similarly, the unit or branch transport path 59 associated with a paper currency separating member of the paper currency reception/delivery port 2 and the unit transport path 51 for the temporary custody unit 4 are brought into operation by the first driving motor mentioned above.

On the other hand, the downstream main transport path 50*b* is put into operation by electrically energizing a second driving motor (not shown) to relate it in one direction. Further, the unit transport paths 52 to 57 for the recycling-destined paper currency storing unit 8, the delivery-destined paper currency storing unit 7, the received paper currency storing unit 6, the rejection-destined paper currency storing unit 9 and the replenishment/collection-destined paper currency storing unit 12, respectively, are put into operation by means of the second driving motor.

By way of example, it is supposed that in a money deposit transaction, the user places plural sheets of paper currencies in the paper currency reception/delivery port 2.

In that case, only the first driving motor is driven rotationally. Thus, the paper currencies fed inwardly from the paper currency reception/delivery port 2 are once stored within the temporary custody unit 4 after having been discriminated as to the denomination by the received paper currency check unit 3. At this juncture, it is to be noted that those received paper currencies which could not be discriminatively identified by the received paper currency check unit 3 or for which abnormality has been detected as to the posture of the paper currency and/or distance between the adjacent paper currencies are inhibited from being stored in the temporary custody unit 4, because, if otherwise, these paper currencies will be mixed with those checked to be normal. Accordingly, the second driving motor mentioned previously is driven to transport the rejection-destined paper currencies to the downstream main transport path 50*b*. Unless the succeeding paper currency is rejected from reception, operation of the second driving motor is stopped.

Consequently, the reception-rejected paper currency are held on the downstream main transport path 50*b*. In this way, the loop-like main transport path 50 which contributes to structural simplification of the paper currency reception/delivery machine should preferably be divided into the upstream main transport path 50*a* driven by the first driving motor and the downstream main transport path 50*b* driven by the second driving motor with reference to the boundary defined by the temporary custody unit 4, wherein the paper currencies decided to be normal by the received paper currency check unit 3 is stored within the temporary custody unit 4 while the rejection-destined paper currency decided to be rejected are held on the downstream main transport path 50*b*. Thus, the normal paper currencies and the rejection-destined paper currency can be distinctly separated from each other.

Figure 7:
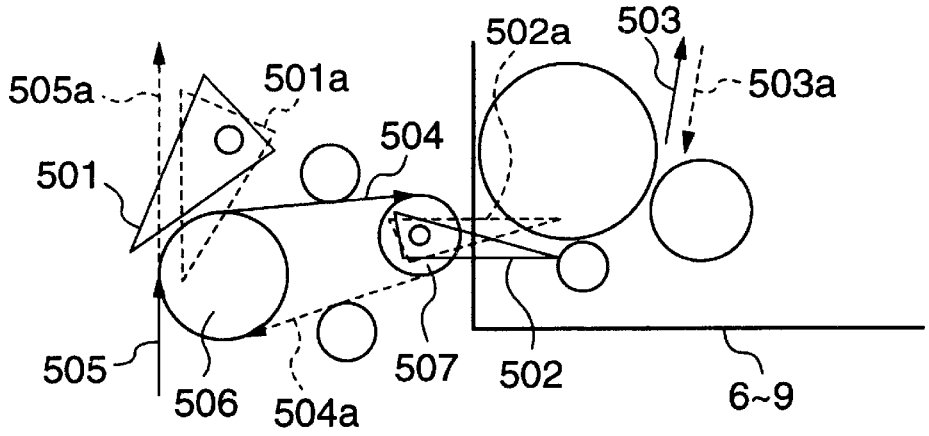
FIG. 7 is a side view for illustrating a structure of unit transport paths in the paper currency reception/delivery machine shown in FIG. 3.

Next, description will turn to the unit transport paths branched to the individual units from the main transport path 50. The unit transport paths 51 to 57 mentioned hereinbefore by reference to FIG. 3 are implemented in a common structure, as shown in FIG. 7, so that the individual units can be exchanged. Referring to FIG. 7, each of the unit transport paths 51 to 57 includes a transporting belt (not shown) spanned between pulleys 506 and 507, wherein a transport path extending in the direction for stacking the paper currencies, as indicated by a solid-line arrow 504, and a transport path extending in the direction for withdrawing the paper currency from the unit, as indicated by a broken-line arrow 504*a*, are formed, respectively. Further, there are provided a storing gate 501 for switching the branch transport path extending from the main transport path 50 and a stacking/feeding change-over gate 502 for changing over the storage of the paper currencies in the unit and the feeding or delivering of the paper currencies from the unit, wherein the storing gate 501 can be controllably changed over between the positions 501 and 501*a* indicated by a solid line and a broken line, respectively, while the stacking/feeding change-over gate 502 can be changed over between the positions 502 and 502*a* indicated by a solid line and a broken line, respectively, by means of associated electromagnetic solenoids, respectively.

When the paper currencies are to be stored within a given unit from the main transport path 50, both the storing gate 501 and the stacking/feeding change-over gate 502 are set to the respective solid line positions under the control of the control system, whereby the paper currencies are transported, as indicated by 504, 505 and 503, to be thereby stacked within the relevant units. On the contrary, when the paper currencies are to be fed to the main transport path 50 from a given unit, a relevant storing gate 501*a* and a stacking/feeding change-over gate 502*a* are changed over to the broken line positions, respectively, whereby the paper currencies are separately taken out from the given units for transportation.

Figure 8:
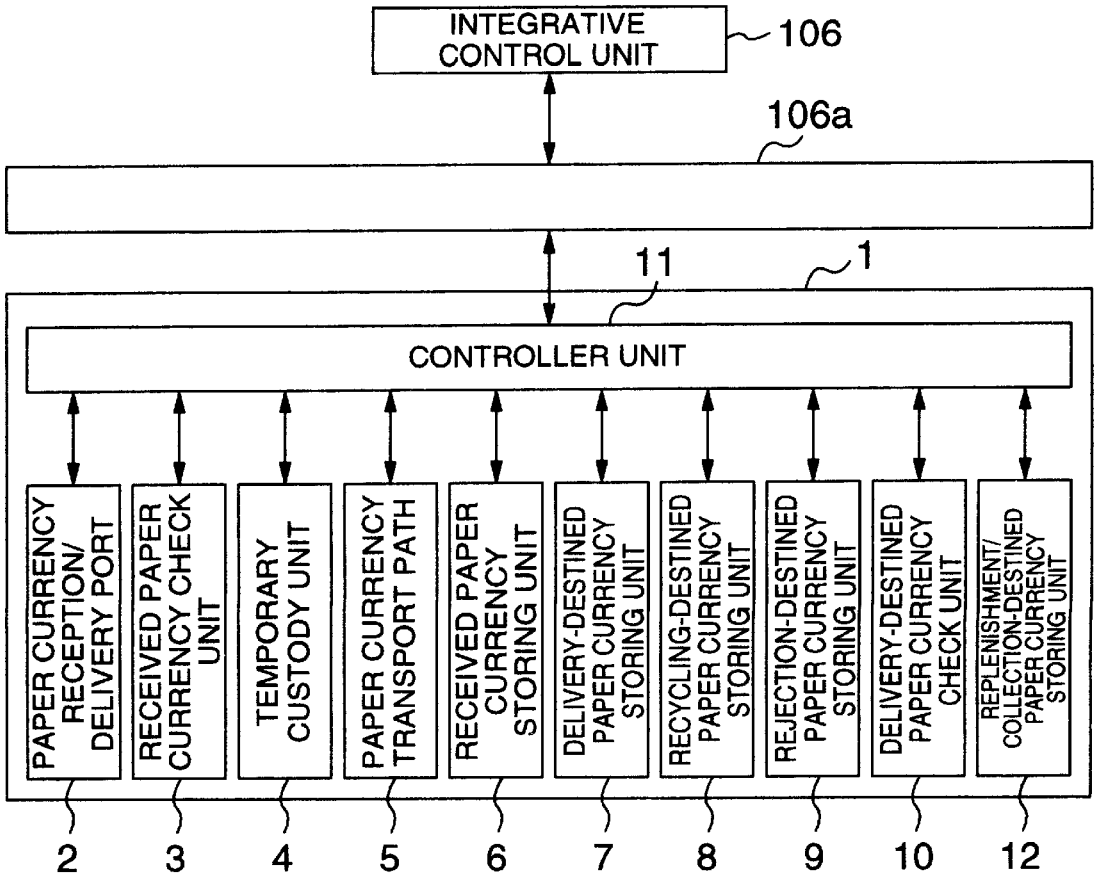
FIG. 8 is a functional block diagram for illustrating control scheme adopted in of the paper currency reception/delivery machine shown in FIG. 3.

FIG. 8 is a block diagram for illustrating major functions carried out internally of the paper currency reception/delivery machine 1 described hereinbefore. Referring to the figure, the controller unit 11 of the paper currency reception/delivery machine 1 is electrically connected to the integrative control unit 106 of the automatic cash transaction apparatus by way of the bus 106*a*, as described hereinbefore by reference to FIGS. 1 and 2, wherein the controller unit 11 is so designed as to control operations of the paper currency reception/delivery machine 1 in accordance with the command(s) issued from the integrative control unit 106 and the detected information of the paper currency reception/delivery machine 1. Further, the controller unit 11 is designed to supply information concerning the states of the paper currency reception/delivery machine 1 to the integrative control unit 106 as occasion requires. To this end, the controller unit 11 is electrically and operatively coupled to the units, the electromagnetic solenoids and the sensors provided in association with the individual component units of the paper currency reception/delivery machine 1 (i.e., the paper currency reception/delivery port 2, the received paper currency check unit 3, the temporary custody unit 4, the paper currency transport path 5, the received paper currency storing unit 6, the delivery-destined paper currency storing unit 7, the recycling-destined paper currency storing unit 8, the rejection-destined paper currency storing unit 9, the delivery-destined paper currency check unit 10 and the replenishment/collection-destined paper currency storing unit 12) for monitoring the transactions by means of the sensor device, to thereby control the relevant actuators in dependence on the transaction and the sensor states. In this way, by controlling operations of the actuators, transportation control of the paper currencies and the switching control of the gates as well as discrimination of the paper currencies can be accomplished.

Next, referring to FIG. 3, description will be directed to the operation of the paper currency reception/delivery machine 1 involved in each transaction while paying attention to the handling of the rejected paper currencies among others.

As described hereinbefore, upon rejection of reception, the paper currencies placed in the paper currency reception/delivery port 2 are transferred along the upstream main transport path 50*a* separately on a sheet-by-sheet basis to the temporary custody unit 4 to be stored once therein. On the other hand, those received paper currencies which could not be discriminatively identified by the received paper currency check unit 3 or for which abnormality has been detected as to the posture of the paper currency and/or distance between the adjacent paper currencies are inhibited from being stored in the temporary custody unit 4 to be transported to the downstream main transport path 50*b*. Unless the succeeding paper currency undergoes the reception rejection, operation of the second driving motor is stopped. Consequently, the reception-rejected paper currencies are held on the downstream main transport path 50*b*. Every time the reception rejection takes place, start and stop of driving the downstream main transport path 50*b* are repeated. Thus, the rejection-destined paper currency can be held or retained in succession. After completion of counting of the received paper currencies, the presser bar 23 provided in association with the paper currency reception/delivery port 2 is moved for making preparation for stacking the paper currencies at the paper currency reception/delivery port 2, whereon the downstream main transport path 50*b* is again driven to thereby allow the rejection-destined paper currencies being retained to be returned to the user through the paper currency reception/delivery port 2.

On the other hand, for the normal or authentic paper currencies stored in the temporary custody unit 4, the rotatable drum 41 installed within the temporary custody unit 4 is rotated reversely after completion or conclusion of transaction of the deposit transaction so that the normal paper currencies as taken up are fed out onto the downstream main transport path 50*b* in succession in the reverse order as compared with the storing of the paper currencies within the temporary custody unit 4. The normal paper currencies thus fed out are then stored in the received paper currency storing unit 6 or the recycling-destined paper currency storing unit 8 or the rejection-destined paper currency storing unit 9 in accordance with the denomination information memorized upon storage of the paper currencies, as described preciously in conjunction with FIGS. 4 and 6. At this juncture, it should be mentioned that the paper currencies to be stored in the rejection-destined paper currency storing unit 9 may include, for example, those which have been decided not forged but authentic by the received paper currency check unit 3 and which are nevertheless incapable of recycling because of damage or partial breakage or the like fault in respect to the physical state.

In this conjunction, it will be helpful for understanding the invention to elucidate the necessity of retaining stationarily at the downstream main transport path 50*b* the paper currencies decided as the rejection-destined paper currencies (i.e., paper currencies to be rejected) by the received paper currency check unit 3.

As described previously, if the rejection-destined paper currencies are stored in the temporary custody unit 4, then the rejection-destined paper currencies will be mixed with the normal or authentic paper currencies. In that case, it is not easy to feed back only the rejection-destined paper currencies to the paper currency reception /delivery port 2. For this reason, the rejection-destined paper currencies have to be discriminatively sorted from the normal or authentic paper currencies to be stored in the temporary custody unit 4. However, in the paper currency receiving/delivering apparatus according to the instant embodiment of the invention, the main transport path 50 is implemented in a simplified loop configuration and operatable only in one direction, as can be seen from the drawings. Besides, there is provided no unit mechanism for retaining temporarily the reception-rejected paper currencies (i.e., paper currencies which can not be received for deposit). Under the circumstances, it is proposed according to the present invention to divide the main transport path 50 into the upstream main transport path 50*a* and the downstream main transport path 50*b*. Thus, it is possible to discriminatively sort the rejection-destined paper currencies and the normal or authentic paper currencies from each other.

Furthermore, although illustration is omitted, it is conceivable according to the present invention that the paper currency reception/delivery port 2 shown in FIG. 3 may be divided into two compartments along a boundary defined by the presser bar 23, wherein one compartment may be used for allowing the user to place the paper currencies therein while the other compartment is used for accommodating therein the rejection-destined paper currencies. By virtue of such arrangement, the normal paper currencies and the rejection-destined paper currencies can be placed separately and distinctively from each other without need for retaining or holding stationarily the rejection-destined paper currencies at the downstream main transport path 50*b*. Besides, the rejection-destined paper currencies can be fed back speedily to the user, to an advantage. Additionally, instead of performing the complicative paper currency transportation control by providing two driving sources in association with the upstream main transport path 50*a* and the downstream main transport path 50*b*, respectively, the paper currency transportation control can be accomplished with only one driving system, to another advantageous effect.

However, in case the above-mentioned arrangement is adopted, then the paper currency reception/delivery port 2 has to be implemented in a large size for affording accommodation of the rejection-destined paper currencies as well. Further, some means has to be provided for controlling the presser bar 23, giving rise to a problem. Thus, it should be appreciated that by adopting the arrangement for retaining stationarily the rejection-destined paper currencies on the downstream main transport path 50*b* as described above by reference to the drawings, the paper currency reception/delivery machine and hence the automatic cash transaction apparatus, a sort of the leaflets handling apparatus, can be realized in a small size without encountering the problems mentioned just above.

Next, description will turn to the operation of the paper currency reception/delivery machine involved in the delivery transaction. In that case, predetermined numbers of paper currencies are delivered onto the main transport path 50 from the storing units or safes provided for given denominations, respectively, in the delivery-destined paper currency storing unit 7 or the recycling-destined paper currency storing unit 8, as described previously by reference to FIGS. 5 and 6. The paper currencies transferred onto the main transport path 50 undergoes check as to the double-ply state or the like in the delivery-destined paper currency check unit 10 to be subsequently placed in the paper currency reception/delivery port 2 from which the user can take out the paper currencies. When delivery rejection occurs in the delivery-destined paper currency check unit 10 (i.e., when the paper currencies to be delivered for payment are rejected by the delivery-destined paper currency check unit 10), the rejected paper currencies are stored in the rejection-destined paper currency storing unit 9, while the paper currencies of an amount corresponding to that of the paper currencies rejected by the delivery-destined paper currency check unit 10 are additionally delivered from the delivery-destined paper currency storing unit 7 or the recycling-destined paper currency storing unit 8.

In case the user neglects unintentionally to take out the paper currencies from the paper currency reception/delivery port 2, the transaction may be terminated as abnormal event with the paper currencies being left within the paper currency reception/delivery port 2 as they are. However, it is desirable to allow the succeeding transaction to be carried out in succession. To this end, it is proposed according to the invention that the paper currencies left in the paper currency reception/delivery port 2 are taken out therefrom to be stored in the received paper currency storing unit 6 or the recycling-destined paper currency storing unit 8 or the rejection-destined paper currency storing unit 9 as desired after the check by the received paper currency check unit 3 as in the case of the money deposit transaction described hereinbefore.

In the paper currency receiving/delivering apparatus according to the instant embodiment of the invention, replenishment, recovery or collection and detailed-checking operation can be performed for the two recycling-destined paper currency storing units 8 by using the replenishment/collection-destined paper currency storing unit 12.

Parenthetically, with the phrase "replenishing operation" or "replenishment", it is contemplated to mean such operation through which the paper currencies to be placed in the two recycling-destined paper currency storing units 8 on a denomination-by-denomination basis can be set en bloc within the replenishment/collection-destined paper currency storing unit 12 instead of forcing the person in charge of service to place them individually and discriminatively in the two recycling-destined paper currency storing units 8. The paper currencies fed out from the replenishment/collection-destined paper currency storing unit 12 are checked as to denominations thereof to be thereby stored selectively and automatically in the recycling-destined paper currency storing units 8 on a denomination-by-denomination basis. On the other hand, the paper currencies delivered from the replenishment/collection-destined paper currency storing unit 12 are checked as to the denominations by means of the received paper currency check unit 3 to be subsequently stored in the replenishment/collection-destined paper currency storing unit 12, being classified on a denomination-by-denomination basis. The paper currencies which could not be identified discriminatively by the received paper currency check unit 3 or other replenishment-rejected paper currency decided to be abnormal in respect to the orientation and the inter-paper distance are stored in the rejection-destined paper currency storing unit 9 as the rejection-destined paper currencies. In this conjunction, it will be appreciated that although the paper currencies set in the replenishment/collection-destined paper currency storing unit 12 by the person in charge of service should intrinsically be normal or authentic paper currencies, there may arise nevertheless such situation that some of these paper currencies will be rejected erroneously by the received paper currency check unit 3. Under the circumstances, it is also taught by the present invention that the paper currencies rejected by the received paper currency check unit 3 are once stored in the temporary custody unit 4 and that after all the paper currencies have been delivered from the replenishment/collection-destined paper currency storing unit 12, the paper currencies stored in the temporary custody unit 4 are taken out to be transferred to the replenishment collection-destined paper currency storing unit 12. By performing again the replenishing operation, the paper currencies decided previously as the rejection-destined paper currencies can now be decided as the normal paper currencies, whereby paper currency replenishing operation can be accomplished with high efficiency.

Now, paper currency collecting operation will be described. With the terms "collecting operation", it is intended to mean such operation that when either of the recycling-destined paper currency storing units 8 becomes full with the paper currencies, a predetermined number of paper currencies are automatically transferred from the recycling-destined paper currency storing unit 8 to the replenishment/collection-destined paper currency storing unit 12 without need for troubling the person in charge of service. The paper currencies fed out from the recycling-destined paper currency storing unit 8 are checked as to the number thereof by means of the delivery-destined paper currency check unit 10 to be subsequently stored in the replenishment/collection-destined paper currency storing unit 12. When rejection of the paper currency or currencies is decided by the delivery-destined paper currency check unit 10, the paper currency as rejected is accommodated within the rejection-destined paper currency storing unit 9.

On the other hand, with the phrase "detailed-checking operation", it is intended to mean such operation that the amount in hand available within the recycling-destined paper currency storing unit 8 (i.e., the amount of the paper currencies resident within the automatic cash transaction apparatus) is automatically determined by counting without forcing the person in charge of service to take out and count manually the paper currencies within all the storing units including the received paper currency storing unit 6, the delivery-destined paper currency storing unit 7, the recycling-destined paper currency storing unit 8 and the rejection-destined paper currency storing unit 9, to thereby mitigate burden imposed on the person in charge of service. More specifically, the person in charge of service sets the empty replenishment/collection-destined paper currency storing unit 12 (or alternatively the recycling-destined paper currency storing unit 8 of the structure substantially same as that of the replenishment/collection-destined paper currency storing unit 12) in the automatic cash transaction apparatus for carrying out the detailed-checking operation. In the first place, all the paper currencies fed out from the one of the recycling-destined paper currency storing units 8 are stored in the empty replenishment/collection-destined paper currency storing unit 12. Thereafter, the paper currencies are again fed out from the replenishment/collection-destined paper currency storing unit 12 and checked as to the denomination and the number of paper currencies by means of the received paper currency check unit 3 to be subsequently stored in the empty recycling-destined paper currency storing unit. Similarly, for the other recycling-destined paper currency storing unit 8, the denomination and the number of the paper currencies are determined. Upon completion of the detailed-checking operation, information concerning the amount of the paper currencies in hand within two recycling-destined paper currency storing units 8 is messaged to the person in charge from the controller unit 11 through the medium of an appropriate information output device mounted on the automatic cash transaction apparatus.

Now, the structure and operations or functions of the paper currency reception/delivery machine according to the instant embodiment of the invention will be elucidated in detail.

As mentioned hereinbefore, the paper currency reception/delivery machine includes one received paper currency storing unit 6, one delivery-destined paper currency storing unit 7, two recycling-destined paper currency storing units 8, one rejection-destined paper currency storing unit 9 and one replenishment/collection-destined paper currency storing unit 12. The received paper currency storing unit 6, the delivery-destined paper currency storing unit 7, the recycling-destined paper currency storing unit 8 and the rejection-destined paper currency storing unit 9 are implemented substantially within identical outer dimensions so that they can removably be mounted or accommodated within the paper currency reception/delivery machine 1. Further, the unit or branch transport paths 52 to 57 are implemented in a common or exchangeable structure. Thus, the paper currency reception/delivery machine 1 can be realized within a high degree of general purpose utility because the numbers of the received paper currency storing unit 6, the delivery-destined paper currency storing unit 7, the recycling-destined paper currency storing unit 8, the rejection-destined paper currency storing unit 9 and the replenishment/collection-destined paper currency storing unit 12 as well as relative disposition thereof can easily be modified.

By way of example, by providing separately the received paper currency storing unit 6 and the delivery-destined paper currency storing unit 7, it is possible to select the recycling-destined paper currency storing unit 8 in place of the received paper currency storing unit 6 and the delivery-destined paper currency storing unit 7, which is advantageous for the bank from the standpoint of monetary management efficiency. It should further be mentioned that the recycling of the paper currencies may be accompanied with the risk of reception of forged paper currencies and the jamming due to injuries of the paper currencies, as the case may be. In order to avoid such problems, it is preferred to provide the received paper currency storing unit 6 and the delivery-destined paper currency storing unit 7 separately from each other.

In case two or more recycling-destined paper currency storing units 8 are provided, it is advantageous to select the replenishment/collection-destined paper currency storing unit 12 for mitigating the load imposed on the maintenance person. In that case, however, there may arise other problems that the manufacturing cost increases and that jamming of the paper currencies is likely to occur because the frequency at which the paper currencies are transferred among the component unit of the automatic cash transaction apparatus also increase. Thus, such arrangement may equally be adopted in that the replenishment/collection-destined paper currency storing unit 12 is spared and that one of three recycling-destined paper currency storing units 8 as mounted is used as the replenishment/collection-destined paper currency storing unit to thereby carrying out the replenishing operation, collecting operation and the detailed-checking operation mentioned previously, as will hereinafter be described by reference to FIG. 9.

Furthermore, the automatic cash transaction apparatus may be operated with the configuration or arrangement of the units shown in FIG. 3 initially upon installation of the automatic cash transaction apparatus at the bank and later on the arrangement of the units may be changed in dependence on the actual money reception/payment status such that the received paper currencies are stored within the rejection-destined paper currency storing unit 9 instead of the received paper currency storing unit 6 which is then replaced by the delivery-destined paper currency storing unit 7 where the number of the delivery-destined paper currency storing units 7 is to be increased in order to cope with an increased number of the delivery transactions as compared with the money deposit transactions, by way of example. Additionally, it is also conceivable to change the operative configuration of the automatic cash transaction apparatus in dependence on the operation load imposed on the automatic cash transaction apparatus. For example, operative configuration of the automatic cash transaction apparatus may be changed between the week days and holidays. In this conjunction, it is noted that the paper currency accommodating capacity of the recycling-destined paper currency storing unit 8 is smaller than that of the delivery-destined paper currency storing unit 7 because a space required for storing the received paper currencies is provided in front of the storing chamber of the recycling-destined paper currency storing unit 8.

Accordingly, it is possible to replace the recycling-destined paper currency storing unit 8 by the delivery-destined paper currency storing unit 7 on the holidays where the delivery transaction of a large amount of paper currencies is expected.

Besides, the paper currency reception/delivery machine according to the present invention can be used as a paper currency receiving machine dedicated only for the paper currency receiving transaction or alternatively as a paper currency delivering (payment) machine dedicated only for delivering the paper currencies by changing correspondingly the positions of the received paper currency storing unit 6 and the delivery-destined paper currency storing unit 7. In particular, when the paper currency reception/delivery machine is to be used as the paper currency delivering machine, the received paper currency check unit 3 and the temporary custody unit 4 may be spared from the internals shown in FIG. 3, because for the paper currency delivering machine, neither the discriminatively identification of the received paper currency nor the temporary storage of the received paper currency is required.

As will now be appreciated, it is possible to change the total numbers of the received paper currency storing unit 6, the delivery-destined paper currency storing unit 7, the recycling-destined paper currency storing unit 8, the rejection-destined paper currency storing unit 9 and the replenishment/collection-destined paper currency storing unit 12 of the paper currency reception/delivery machine according to the instant embodiment of the invention. When the number of a given unit is to be increased, this can be accomplished by stacking additionally a correspondent one. In that case, the height of the paper currency reception/delivery machine 1 increases. On the other hand, when a given unit of the paper currency reception/delivery machine 1 becomes unnecessary in dependence on application, the paper currency reception/delivery machine 1 may be operated with the unnecessary unit being held inoperative or alternatively the latter may be removed from the paper currency reception/delivery machine 1. In that case, the height of the paper currency reception/delivery machine 1 decreases correspondingly, which in turn means that the paper currency reception/delivery machine 1 can be implemented in a reduced or miniature size.

Of the received paper currency storing unit 6, the delivery-destined paper currency storing unit 7, the recycling-destined paper currency storing unit 8, the rejection-destined paper currency storing unit 9 and the replenishment/collection-destined paper currency storing unit 12, the received paper currency storing unit 6 and the rejection-destined paper currency storing unit 9 can be exchanged with each other and such exchangeability exists between the recycling-destined paper currency storing unit 8 and the replenishment/collection-destined paper currency storing unit 12. Of course, a plurality of delivery-destined paper currency storing units 7 incorporated are correspondently or mutually exchangeable. Thus, by providing a display and a storage (memory) in association with these units serving as the saves, respectively, for thereby making it possible to display and/or store the information concerning the identification of the storing units, the denominations, number of the paper currencies as store and the like, handleability of the automatic cash transaction apparatus can be enhanced while suppressing possibility of the various storing units being erroneously mounted or removed. As a result, very strict monetary management can be realized.

The rejection-destined paper currency storing unit 9, the replenishment/collection-destined paper currency storing unit 12 and the delivery-destined paper currency check unit 10 are disposed downstream of the received paper currency storing unit 6, the delivery-destined paper currency storing unit 7 and the recycling-destined paper currency storing unit 8 (i.e., at the side for delivering the paper currencies) by taking into account the degree of freedom in selecting the received paper currency storing unit 6, the delivery-destined paper currency storing unit 7 and the recycling-destined paper currency storing unit 8 in the case of the paper currency reception/delivery machine 1 described above. However, the received paper currency storing unit 6 and the delivery-destined paper currency check unit 10 may be exchanged in the disposition thereof. In that case, distance between the delivery-destined paper currency check unit 10 and the switching gate for transferring the paper currencies to the rejection-destined paper currency storing unit 9 can be increased, which in turn means that a vertical space between the received paper currency storing unit 6 and the rejection-destined paper currency storing unit 9 required ensuring a time for the delivery-destined paper currency check unit 10 to perform the paper currency discriminating operation can be spared, whereby the overall height of the paper currency reception/delivery machine 1 and hence that of the automatic cash transaction apparatus can be decreased. In other words, the automatic cash transaction apparatus can be realized in a small size.

Further, it should be added that the features mentioned below can contribute to miniaturization of the automatic cash transaction apparatus.

Firstly, the temporary custody unit 4 may be implement in the form of a stacking/feeding mechanism for delivering the paper currencies one by one from the paper currency stack as stored, similarly to the recycling-destined paper currency storing unit 8. However, such structure of the temporary custody unit 4 that the paper currencies are wound around the rotatable drum together with the guide tape for storage and delivery of the paper currencies as described above can ensure higher reliability or security for the delivery of the paper currencies because the double-ply state of the paper currencies can be positively prevented owing to the paper currencies comparing function of the guide tape, as described hereinbefore. This arrangement renders it unnecessary to provide a received paper currency check unit at a location along the paper currency transport path for transporting the paper currency from the temporary custody unit 4 to the received paper currency storing unit 6. Thus, the overall size of the paper currency reception/delivery machine 1 and hence that of the automatic cash transaction apparatus can be reduced correspondingly.

Secondarily, by incorporating in the paper currency reception/delivery machine 1 the delivery-destined paper currency check unit 10 of a simpler structure than that of the received paper currency check unit 3, the paper currency transport path 5 can be so arranged as to carry the paper currencies from the delivery-destined paper currency storing unit 7 to the paper currency reception/delivery port 2 without passing through the received paper currency check unit 3. Thus, the paper currency transport path 5 can be implemented in a simple circular loop form, as can be seen in FIG. 3.

Thirdly, owing to such arrangement that the rejection-destined paper currencies contained in those received upon deposit are temporarily held on the downstream main transport path 50*b*, as described hereinbefore, there arises no necessity to provide a storing portion for collecting the reception-rejected paper currencies by stacking them.

Fourthly, in the automatic cash transaction apparatus according to the invention, the paper currency receiving port (deposit port) and the paper currency delivering port (payment port) may be provided separately from each other substantially to the same effect. However, by implementing the paper currency receiving port and the paper currency delivering port in an integral structure as the paper currency reception/delivery port, as described hereinbefore, the paper currencies neglected to be taken out by the user upon payment can be fed into the paper currency reception/delivery machine 1 from the paper currency reception/delivery port 2 as in the case of deposit to be subsequently accommodated within the rejection-destined paper currency storing unit 9. Thus, it is unnecessary to dispose a neglected paper currency collecting box in the vicinity of the paper currency reception/delivery port as in the case of conventional automatic cash transaction apparatuses.

Fifthly, the unit transport paths 51 to 57 constituting the paper currency transport path 5 are implemented in a common structure, as described hereinbefore by reference to FIG. 7. By virtue of this feature, the paper currencies can be transferred among the relevant units in the storing and feeding directions 503 and 503*a* with the pulleys 506 and 507 being driven only in one direction. Thus, for driving the unit transport paths 51 to 57, a driving source common to the main transport path 50 can be employed.

Owing to the effects described above or synergy thereof, the paper currency transport path 5 can be implemented in a simplified structure which includes the main transport path 50 extending through the received paper currency check unit 3 and the delivery-destined paper currency check unit 10 and in the vicinity of the other individual units in a loop-like fashion for carrying the paper currencies in one direction and the unit transport paths 51 to 59 branching from the main transport path 50 at intermediate portions thereof for transferring the paper currencies with the associated units, respectively. Thus, the paper currency transport path system can be implemented in a much simplified structure as compared with the conventional automatic cash transaction apparatus incorporating the complicated paper currencies transport path structure.

In the automatic cash transaction apparatus incorporating the paper currency reception/delivery machine according to the instant embodiment of the invention, the received paper currency storing unit 6,.the delivery-destined paper currency storing unit 7, the recycling-destined paper currency storing unit 8 and the rejection-destined paper currency storing unit 9 which are ordinarily manipulated by the person in charge of service are disposed in a stack at a rear side of the automatic cash transaction apparatus (at the right side as viewed in FIG. 3). Thus, the individual storing units can be individually and separately withdrawn in the horizontal direction from the automatic cash transaction apparatus at the rear side thereof, which ensures easier handling or manipulation of the individual storing units. Abnormal event such as jamming of the paper currencies is likely to occur between the storing units and the relevant unit transport paths 51 to 57. However, such jamming state can easily be cleared because of easy removal and placement of the storing units. Besides, even when a given storing unit is removed from the automatic cash transaction apparatus in order to takeout or replenish the paper currencies from or into the given storing unit, the transaction for which the given storing unit is not employed can be carried out without need for shutdown of the whole automatic cash transaction apparatus.

It should be mentioned that the automatic cash transaction apparatus according to the instant embodiment of the invention is so designed to be capable of handling a very wide variety of paper currencies.

The paper currencies denominated in Japanese yen are generally in sizes of 150 to 160 mm in length and 76 mm in width. The automatic cash transaction apparatus according to the instant embodiment of the invention can be so designed as to handle the foreign currencies of larger or smaller sizes than Japanese paper currencies. In other words, the automatic cash transaction apparatus can handle almost all of the foreign currencies worldwide. More specifically, the width of the storing space of the individual units (the paper currency reception/delivery port 2, the received paper currency storing unit 6, the delivery-destined paper currency storing unit 7, the recycling-destined paper currency storing unit 8, the rejection-destined paper currency storing unit 9 and the replenishment/collection-destined paper currency storing unit 12) may be selected to be ca. 100 mm with the length of the storing space being ca. 200 mm. Further, the width of the spaces secured above the transport path (i.e., the received paper currency check unit 3, the temporary custody unit 4, the paper currency transport path 5 and the delivery-destined paper currency check unit 10) may be selected ca. 220 mm. Furthermore, the minimum size of the paper currency capable of handling by the automatic cash transaction apparatus may be selected to be ca. 60 mm in width and 120 mm in length, wherein each of the storing units such as the received paper currency storing unit 6, the delivery-destined paper currency storing unit 7 and the like in which the paper currencies are placed by the maintenance person may be provided with an adjustable regulating guide means (not shown) for controlling the alignment of the paper currencies as handled in the longitudinal direction and the widthwise direction.

The recycling-destined paper currency storing unit 8 is so designed as to feed out the paper currencies upwardly upon reception of the paper currencies, while feeding out the paper currencies upon delivering thereof with the paper currencies as received being stacked in the horizontal direction so that the paper currencies of different sizes, in particular those differing in the width, can be aligned at the lower ends of the paper currency along a bottom plate 88 under the gravity. Thus, upon delivering operation, the leading ends of the paper currencies are aligned with one another. This feature can contribute to stable or reliable paper currency delivery or feed-out operation of the paper currency reception/delivery machine 1. To say in another way, when compared with the conventional recycling-destined paper currency storing unit designed for stacking the paper currencies in the vertical direction, there can be ensured improved paper currency separating function or efficiency in the automatic cash transaction apparatus according to the invention because of such arrangement that upon stacking of the paper currencies, the dropping paper currencies are stacked, being aligned at one ends thereof under the action of gravity, while separative delivering (feeding-out) of the paper currencies is performed from the side of the aligned ends of the paper currencies. Thus, paper currency separating operation of the automatic cash transaction apparatus can be improved considerably. For the separating mechanism, reliability of detection of the double-ply state of the paper currencies is affected not a little by the alignment state of the tip ends of the paper currencies. In particular, when the paper currencies of different sizes such as foreign currencies are stored in the recycling-destined paper currency storing unit and delivered therefrom, the feed-out thereof from the bottom of the recycling-destined paper currency storing unit in the state where the lower ends of the paper currencies are aligned can ensure high reliability for the paper currency deliver operation.

Because of the capability of the paper currency reception/delivery machine 1 for handling a very wide variety of the paper currencies, the paper currency reception/delivery machine 1 according to the instant embodiment of the invention can handle other leaflets than the paper currencies. By way of example, for issuing tickets, guide pamphlets or the like by using the apparatus according to the invention, they may be simply placed within the delivery-destined paper currency storing unit 7. Further, when the apparatus according to the invention is to be used for issuing or delivering account chits for transactions, checks or the like which require data printing operation, a printing mechanism may be provided at an appropriate location along the paper currency transport path 5. Alternatively, the delivery-destined paper currency storing unit 7 may be replaced by a unit dedicated to such application and incorporating a storing unit, a delivering mechanism and a printing mechanism. In this conjunction, when a reading unit for reading the identification number, as required for issuing traveller's checks or the like printed with identification numbers, such reading unit may be incorporated similarly to the printing mechanism. Alternatively, the identification-numbered leaflets may be caused to pass through the received paper currency check unit 3 for reading the identification number to be subsequently fed out to the paper currency reception/delivery port 2. Accordingly, it should be appreciated that the terms "paper currency" and "leaflets" are used only for the convenience of description and thus should not be interpreted exactly or strictly. With the terms "paper currency" and "leaflets" used herein, it is contemplated to encompass the bills, account chits, checks, securities, thin card or the like articles.

In the paper currency receiving/delivering apparatus according to the instant embodiment of the invention, the individual units (the paper currency reception/delivery port 2, the received paper currency check unit 3, the temporary custody unit 4, the received paper currency storing unit 6, the delivery-destined paper currency storing unit 7, the recycling-destined paper currency storing unit 8, the rejection-destined paper currency storing unit 9, the delivery-destined paper currency check unit 10 and the replenishment/collection-destined paper currency storing unit 12) are implemented independent of one another, wherein the paper currency transport path 5 is so arranged as to interconnect these units individually and independently, as can be understood from the foregoing description. Thus, handling of the apparatus such as assemblability, transportability and the like can be much facilitated. Besides, rearranging the dispositions of the individual units and interconnecting them in an array differing from that of the paper currency reception/delivery machine according to the instant embodiment of the invention, other types of paper currency receiving/delivering apparatuses can be realized for carrying out other functions as desired.

In the following, other embodiments of the present invention will be described by reference to FIGS. 9 to 15.

Embodiment 2

Figure 9:
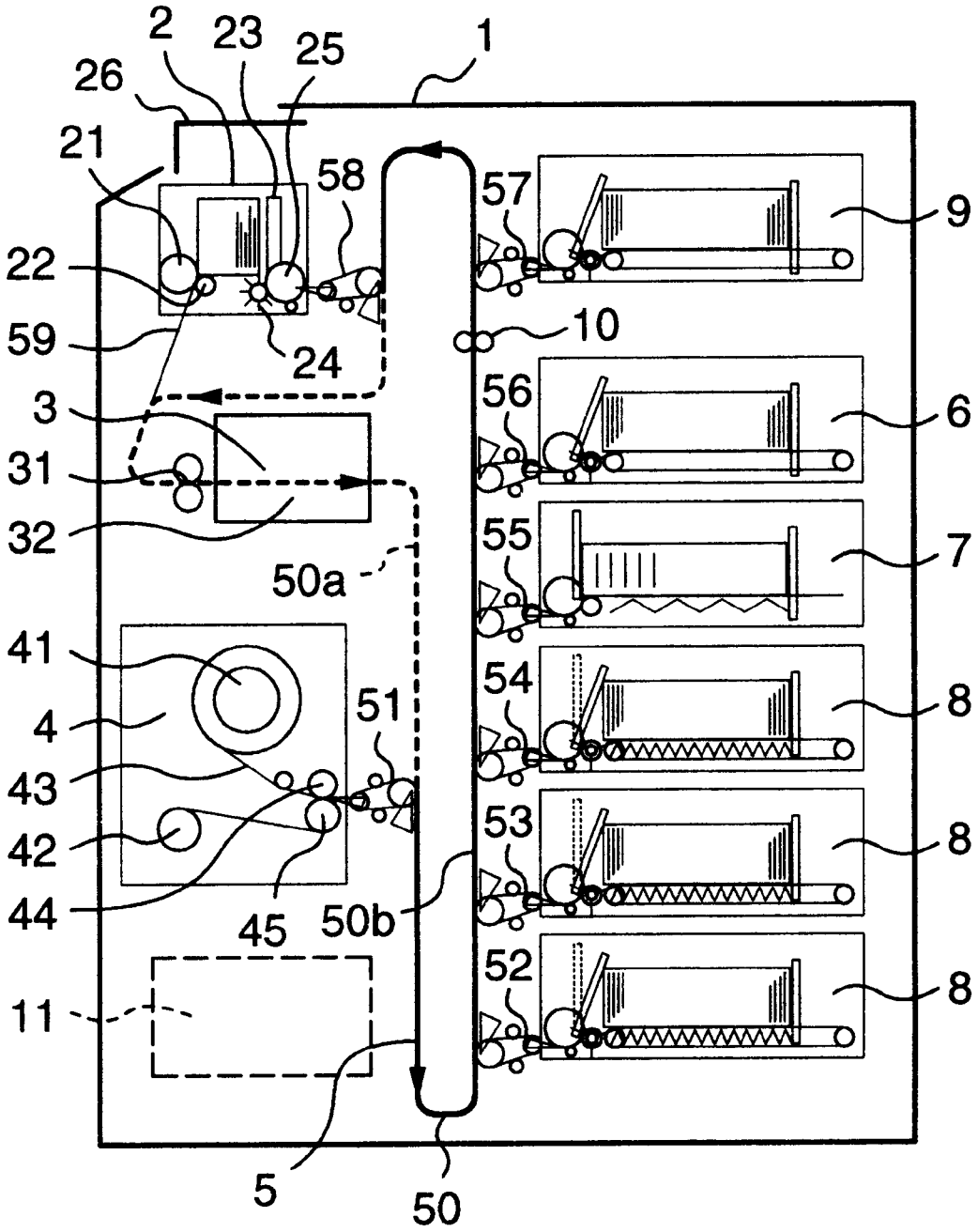
FIG. 9 is a side elevational view showing schematically an internal structure of a paper currency reception/delivery machine according to a second embodiment of the invention.

FIG. 9 is a view showing a paper currency receiving/delivering apparatus according to a second embodiment of the present invention. As can be seen in the figure, the paper currency receiving/delivering apparatus now under consideration incorporates three recycling-destined paper currency storing units, one of which is used as a replenishment/collection-destined paper currency storing unit. In this paper currency receiving/delivering apparatus, the recycling-destined paper currency storing unit 8 (recycle box) which is to serve as the replenishment/collection-destined paper currency storing unit should be disposed topmost in the stack of three boxes, because then the double-ply state of the paper currencies can be excluded more positively. In that case, however, there may arise crossing or intersection of the transport path. In order to evade such situation, the paper currencies may be stored in the temporary custody unit on a predetermined-number basis for thereby effectuating the replenishment or collection of the paper currencies by classifying them into groups or sets each including a predetermined number of paper currencies.

Embodiment 3

Figure 10:
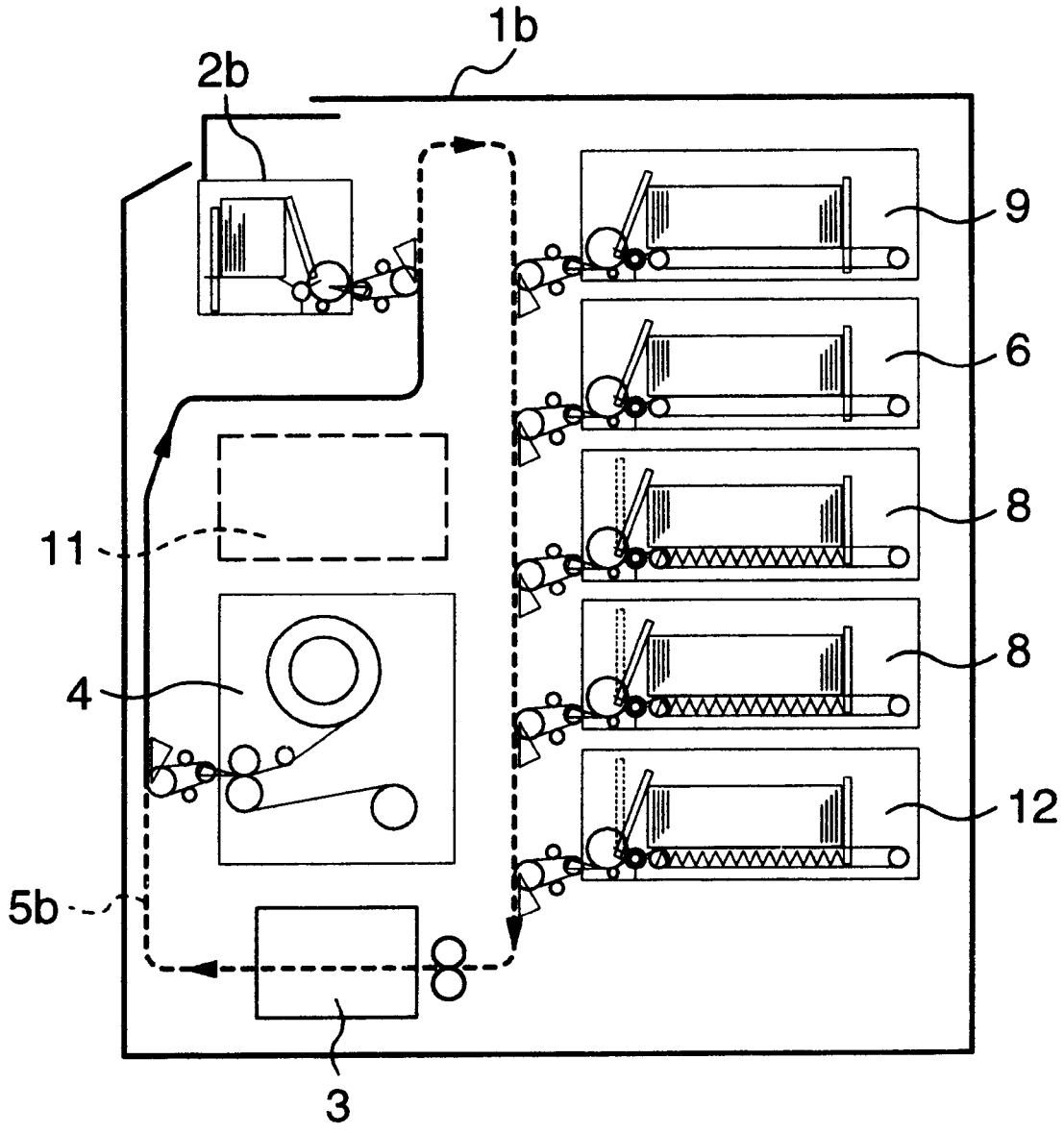
FIG. 10 is a side elevational view showing schematically an internal structure of a paper currency reception/delivery machine according to a third embodiment of the invention.

FIG. 10 shows the paper currency reception/delivery machine 1*b* according to a third embodiment of the present invention. As can be seen in the figure, there are disposed at the rear side (right-hand side as viewed in the figure) one rejection-destined paper currency storing unit 9, one received paper currency storing unit 6, two recycling-destined paper currency storing units 8 and one replenishment/collection-destined paper currency storing unit 12 in this order from the top side of the apparatus. The paper currency reception/delivery machine 1*b* differs from the apparatus according to the first embodiment described hereinbefore by reference to FIG. 3 not only in the number of the units but also in respect to the disposition thereof. Besides, the transportation control for transferring the paper currencies to a paper currency transport path 5*b* differs from the first embodiment. More specifically, in the case of the paper currency reception/delivery machine shown in FIG. 3, the paper currencies fed in from the paper currency reception/delivery port are transported in the counterclockwise direction. By contrast, in the case of the paper currency reception/delivery machine 1*b* according to the third embodiment of the invention, the paper currencies are transported in the clockwise direction in conformance with the array of the individual storing units mentioned above. Furthermore, there are disposed the received paper currency check unit 3 and the temporary custody unit 4 in this order in association with each of the storing units downstream thereof. However, the delivery-destined paper currency check unit 10 described in conjunction with the first embodiment is not provided in the paper currency reception/delivery machine 1*b* according to the instant embodiment. Accordingly, the received paper currencies as well as those to be delivered for payment are all checked by the received paper currency check unit 3 in respect to the denominations, authenticity and the double-ply state.

In the paper currency reception/delivery machine 1*b* according to the third embodiment of the invention, the paper currencies placed in a paper currency reception/delivery port 2*b* are transported in the clockwise direction along the transport path in the vicinity of the individual storing units (9, 6, 8, 12) and undergo the discriminative identification or the check performed by the received paper currency check unit 3 to be subsequently stored temporarily within the temporary custody unit 4. After successful completion of the transaction, the paper currencies are stored in the received paper currency storing unit 6 or the recycling-destined paper currency storing unit 8, passing again by the paper currency reception/delivery port 2*b*. The paper currency received as deposit and decided as the rejection-destined paper currency is held or retained on a paper currency transport path 5*b* (solid line) extended by solid line between the temporary custody unit 4 and the paper currency reception/delivery port 2*b*. When the payment transaction is selected by a customer, the paper currencies are delivered onto the paper currency transport path 5*b* from the recycling-destined paper currency storing unit 8 to be subsequently checked as to the double-ply or overlap state by means of the received paper currency check unit 3. Finally, the paper currencies are placed in the paper currency reception/delivery port 2*b* for payment. As will now be appreciated from the foregoing, in the case of the paper currency reception/delivery machine 1*b* according to the third embodiment of the invention, the delivery-destined paper currency check unit 10 described hereinbefore in conjunction with the first embodiment need not be incorporated while ensuring discriminative identification or check concerning the denomination and the number of paper currencies. Thus, the paper currency reception/delivery machine 1*b* according to the third embodiment of the invention is very advantageous from the standpoint of cost and operation performed. Besides, because the separating/stacking mechanism provided in association with the paper currency reception/delivery port 2*b* is implemented in an integral structure, the number of parts as demanded can be reduced, which is profitable from the economical viewpoint.

Embodiment 4

Figure 11:
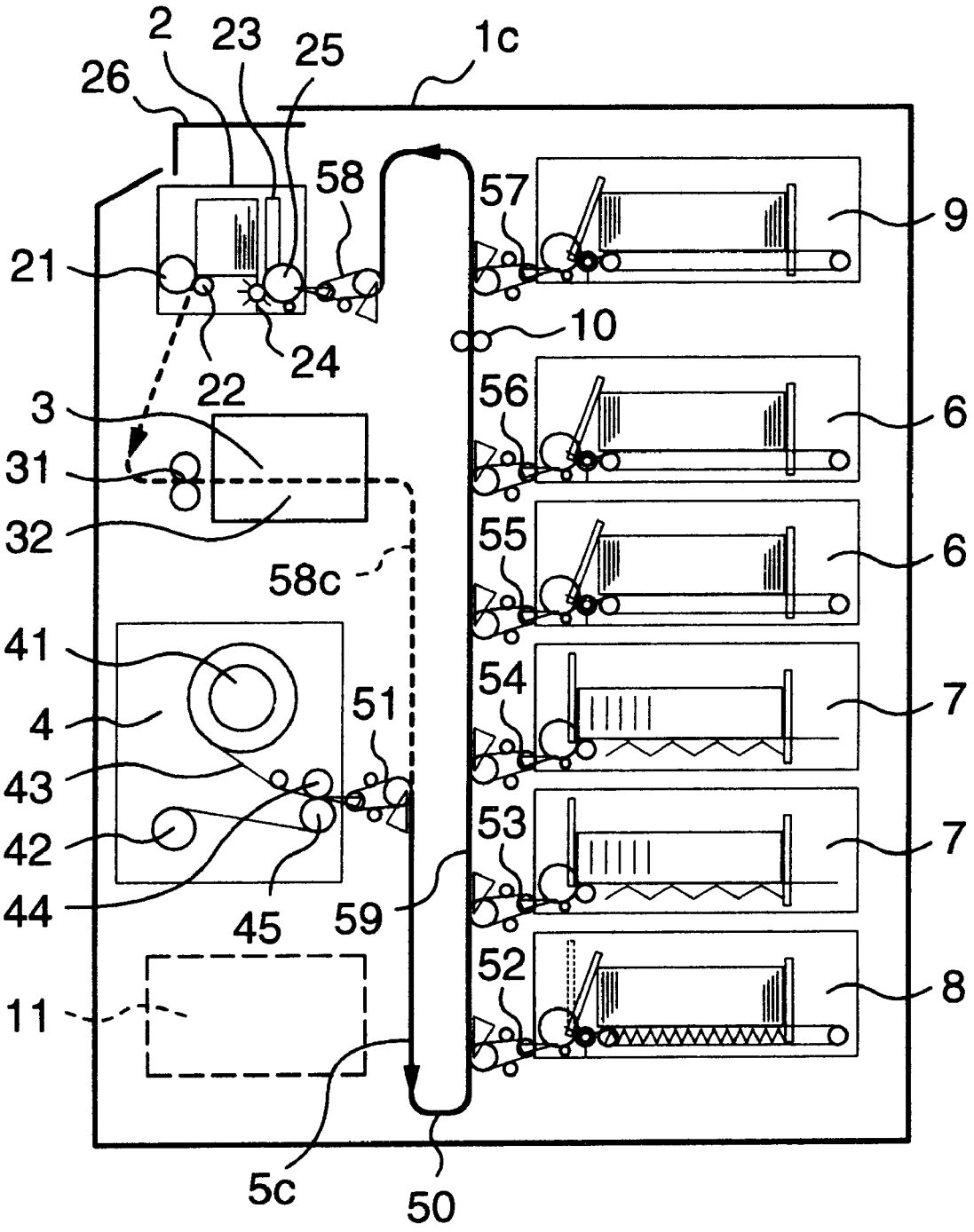
FIG. 11 is schematic side elevational view showing schematically an internal structure of a paper currency reception/delivery machine according to a fourth embodiment of the invention.

FIG. 11 is a view showing schematically a paper currency reception/delivery machine 1*c* according to a fourth embodiment of the present invention. The paper currency reception/delivery machine 1*c* differs from the machine according to the second embodiment in that a transport path section of the upstream main transport path 58*c* of a paper currency transport path 5*c* is not provided below the paper currency reception/delivery port 2. The transport path section mentioned above is put into operation only for the replenishing operation and the detailed-checking operation. Thus, the paper currency reception/delivery machine 1*c* according to the fourth embodiment of the invention can find application to the automatic cash transaction apparatus in which neither the replenishing operation nor the detailed-checking operation is necessary. The paper currency reception/delivery machine 1*c* is advantageous in respect to the manufacturing cost.

Embodiment 5

Figure 12:
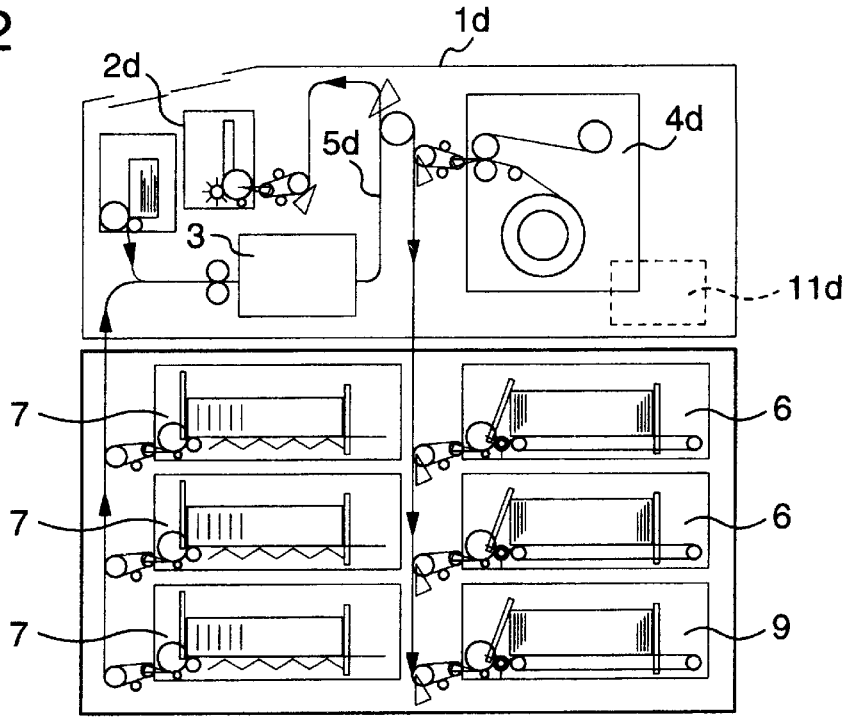
FIG. 12 is a side elevational view showing schematically an internal structure of a paper currency reception/delivery machine according to a fifth embodiment of the invention.

FIG. 12 shows schematically a paper currency reception/delivery machine 1*d* according to a fifth embodiment of the present invention. The paper currency reception/delivery machine according to the instant embodiment features that two received paper currency storing units 6, three delivery-destined paper currency storing units 7 and one rejection-destined paper currency storing unit 9 are assembled in a unitary block distinctively from the other units and disposed at a lower portion of the paper currency reception/delivery machine 1*d*. Further, the paper currency reception/delivery port designated by 2*d* is divided into a paper currency receiving compartment in which the paper currencies are to be placed for the deposit and a paper currency delivering compartment to which paper currencies are fed out upon payment transaction. As can be seen in the figure, a first group of the delivery-destined paper currency storing units 7 and a second group including the received paper currency storing units 6 and the rejection-destined paper currency storing unit 9 are disposed rowwise in opposition to each other with the transport path being interposed therebetween. (The first group is disposed at the left-hand side with the second group being disposed at the right-hand side in FIG. 12.) By virtue of the arrangement of the units mentioned above, the height of the paper currency reception/delivery machine can be reduced significantly and thus the paper currency receiving/delivering apparatus can be implemented in a small size.

The paper currencies placed in the receiving compartment of the paper currency reception/delivery port 2*d* are checked by the received paper currency check unit 3 disposed downstream, wherein the paper currency or paper currencies decided to be rejected is immediately returned to the delivering compartment of the paper currency reception/delivery port 2*d* while the paper currency decided to be normal is retained temporarily in a temporary custody unit 4*d* being fed thereto along a paper currency transport path 5*d*. After completion of the deposit transaction, the paper currencies are transported to the paper currency storing units disposed at the lower portion of the paper currency receiving/delivering apparatus and thence to the received paper currency storing unit 6. On the other hand, upon selection of the delivery transaction, paper currencies are fed out from the delivery-destined paper currency storing unit 7 to be checked by the received paper currency check unit 3 located downstream and ultimately placed in the paper currency delivering compartment of the paper currency reception/delivery port 2*d*. In that case, the paper currencies for which double-ply or superposition is detected by the received paper currency check unit 3 are stored in the rejection-destined paper currency storing unit 9. To say in another way, not only the paper currencies received for deposit but also those to be delivered for payment are checked by the received paper currency check unit 3 in the paper currency reception/delivery machine according to the fifth embodiment of the invention owing to this feature, the delivery-destined paper currency check unit 10 dedicated for the paper currency delivery for payment can be spared. Thus, the paper currency reception/delivery machine according to the instant embodiment of the invention is advantageous from the standpoint of manufacturing cost and operation performance even though the structure of the paper currency transport path 5*d* in the vicinity of the received paper currency check unit 3 becomes complicated more or less (see FIG. 12). Furthermore, as can be seen in FIG. 12, the paper currency transport path 5*d* is constituted by one transport path section extending between the received paper currency storing unit group and the delivery-destined paper currency storing unit group, a transport path section for transporting the paper currency in the direction from the top toward the bottom, and one transport path section extending in front of the delivery-destined paper currency storing units 7. In other words, the transport path sections can be classified into the section for transporting the paper currencies upwardly and the section for transporting them downwardly, which means that the transport path system can be realized in a simple structure. Owing to this feature, the individual paper currency storing units can be exchanged or replaced very easily. At this juncture, it should be mentioned that the paper currency transportation control, the paper currency discrimination control and other controls are effectuated by the controller unit 11*d*. It goes without saying that the paper currency transport/check control is performed by the respective controller unit 11*d* (same holds true for all the embodiments of the invention disclosed herein).

The types or species of the paper currencies received by the apparatus for deposit will be mentioned. In the case of the paper currency receiving/delivering apparatus according to the fifth embodiment of the invention shown in FIG. 12, only two received paper currency storing units 6 are employed. Consequently, it may seem that the paper currency receiving/delivering apparatus is capable of handling only the paper currencies of two different denominations. However, by dedicating these two received paper currency storing units 6 for storing the paper currencies having high circulation ratio while dedicating the rejection-destined paper currency storing unit 9 for storing the paper currencies having lower circulation ratios, a large variety of paper currencies can be accommodated within the rejection-destined paper currency storing unit 9, which in turn means that the paper currency reception/delivery machine 1*d* can handle the paper currencies of three or four or more different denominations. Such advantageous feature is not specific to the paper currency reception/delivery machine 1*d* according to the fifth embodiment of the invention but can equally be imparted to the paper currency reception/delivery machines described hereinbefore as well as those described subsequently.

Embodiment 6

Figure 13:
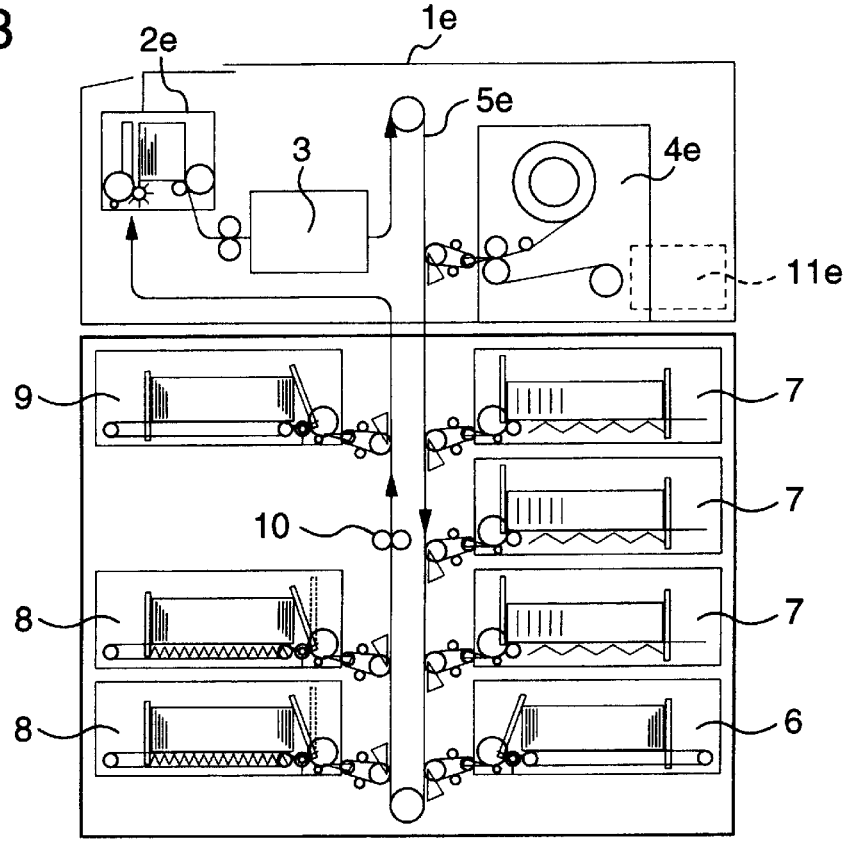
FIG. 13 is a side elevational view showing schematically an internal structure of a paper currency reception/delivery machine according to a sixth embodiment of the present invention.

FIG. 13 is a view showing a paper currency reception/delivery machine 1*e* according to a sixth embodiment of the present invention. Parenthetically, the paper currency reception/delivery machine 1*e* is a modification of the apparatus shown in FIG. 12. As in the case of the fifth embodiment, the storing unit group for storing the paper currencies is assembled into one block and disposed at a lower portion of the paper currency receiving/delivering apparatus, being distinguished from the other units. By virtue of such arrangement, the storing unit group can be exchanged on a block basis regardless of change in the number of the storing units (safe units) and the outer dimensions of the apparatus. The paper currency reception/delivery machine 1*e* according to the instant embodiment of the invention features particularly the arrangement of the storing units. As can be seen from the figure, the paper currency transport path 5*e* is so disposed as to turn back from the bottom end, being confined within a center space of the paper currency reception/delivery machine, wherein the rejection-destined paper currency storing unit 9, the delivery-destined paper currency-check unit 10 and two recycling-destined paper currency storing units 8 are disposed at the front side relative to the paper currency transport path 5*e* while three delivery-destined paper currency storing units 7 and one received paper currency storing unit 6 are disposed at the rear side. Further, the paper currency reception/delivery port 2*e* is so implemented as to serve for both the functions of paper currency receiving port and paper currency delivering port. By virtue of the structure of the paper currency reception/delivery machine described above, exchange of the safe or storing units or boxes can be carried out not only at the rear side but also at the front side. The paper currencies placed in the paper currency reception/delivery port 2*e* serving for reception and delivery of the paper currencies are fed to the received paper currency check unit 3 to be checked and then stored in the recycling-destined paper currency storing units 8. On the other hand, the paper currencies fed out from the delivery-destined paper currency storing unit 7 or the recycling-destined paper currency storing unit 8 are checked by the delivery-destined paper currency check unit 10. Further, by arraying the received paper currency storing unit 6, the delivery-destined paper currency storing units 7 and the rejection-destined paper currency storing unit 9 vertically in two rows, the number of the safe or storing units or boxes which can be accommodated within the automatic cash transaction apparatus can be increased without increasing the overall height of the apparatus.

Embodiment 7

Figure 14:
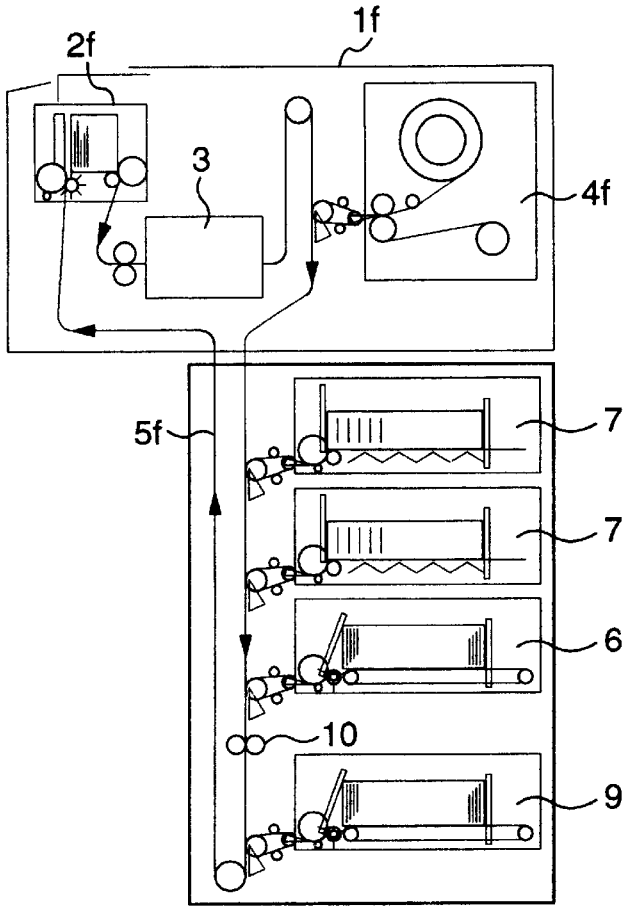
FIG. 14 is a side elevational view showing schematically an internal structure of a paper currency reception/delivery machine according to a seventh embodiment of the invention.

FIG. 14 is a view showing schematically an internal structure of a paper currency reception/delivery machine 1*f* according to a seventh embodiment of the invention. In the case of the machine according to the instant embodiment, a group of storing units or safe boxes for receiving the paper currencies are disposed as an assembly or a block at a lower portion of the automatic cash transaction apparatus. More specifically, the delivery-destined paper currency storing units 7, the received paper currency storing unit 6, the delivery-destined paper currency check unit 10 and the rejection-destined paper currency storing unit 9 are stacked each in lying disposition in this order as viewed from the top. Consequently, in the state in which the above-mentioned units are mounted within the paper currency reception/delivery machine if, a lower front portion of the automatic cash transaction apparatus corresponding to legs of the user is offset rearwardly. Thus, this arrangement affords comfortableness to the user upon his or her transaction with the machine. The paper currencies received through the paper currency reception/delivery port 2*f* are checked by the received paper currency check unit 3 while the paper currencies fed out from the delivery-destined paper currency storing unit 7 are checked by the delivery-destined paper currency check unit 10. In that case, when the double-ply state of the paper currencies is detected by the delivery-destined paper currency check unit 10 upon delivery operation for payment, the relevant paper currencies are stored in the rejection-destined paper currency storing unit 9 with a corresponding amount of paper currencies being fed out onto the paper currency transport path 5*f* again from the delivery-destined paper currency storing unit 7 to be delivered to the paper currency reception/delivery port 2*f*. Owing to the structure described above, the paper currency reception/delivery machine 1*f* is suited for implementation with a small size which incorporates four or less safe or storing units.

Embodiment 8

Figure 15:
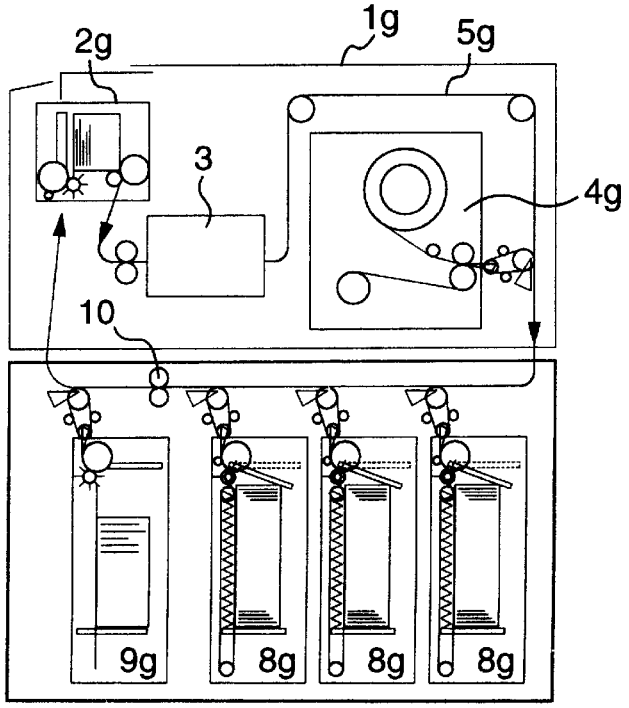
FIG. 15 is a side elevational view showing schematically an internal structure of a paper currency reception/delivery machine according to an eighth embodiment of the present invention.

FIG. 15 is a view showing schematically an internal structure of a paper currency reception/delivery machine 1*g* according to an eighth embodiment of the invention. In this paper currency reception/delivery machine 1*g*, a group of a rejection-destined paper currency storing unit 9*g* and recycling-destined paper currency storing units 8*g* is disposed as an assembly or block at a lower portion. As can be seen in the figure, the three recycling-destined paper currency storing units 8*g* and one rejection-destined paper currency storing unit 9*g* are arrayed each in an upstanding disposition in a horizontal row so that the paper currencies can be stacked in the vertical direction in each of the storing units by arranging correspondingly the rollers and other members. The structure of the paper currency reception/delivery machine 1*g* shown in FIG. 15 is suited profitably for the automatic cash transaction apparatus designed to handle the paper currencies to be recycled. Additionally, the automatic cash transaction apparatus can be implemented in a miniature size with small height and depth. The paper currencies fed out from the recycling-destined paper currency storing unit 8*g* is checked as to the double-ply or overlap state and others, as mentioned hereinbefore. The rejected paper currencies are stored within the rejection-destined paper currency storing unit 9*g*. Other features of the paper currency reception/delivery machine 1*g* are substantially similar to those described hereinbefore in conjunction with other embodiments of the invention and thus repetitive description thereof will be unnecessary.

Many features and advantages of the present invention are apparent from the detailed description and thus it is intended by the appended claims to cover all such features and advantages of the system which fall within the true spirit and scope of the invention. Further, since numerous modifications and combinations will readily occur to those skilled in the art, it is not intended to limit the invention to the exact construction and operation illustrated and described.

By way of example, n one of the paper currency reception/delivery machine according to the fourth to eighth embodiments of the invention incorporates the replenishment/collection-destined paper currency storing unit 12 with preference being put to inexpensive implementation in a small or miniature size. Consequently, the paper currency transport path 5 can not be realized in a simple loop-like configuration because the paper currency transport path 5 is required to pass by the paper currency reception/delivery port 2. Further, the replenishment, collection and detailed check of the paper currencies can not be carried out. It should however be mentioned that by connecting the transport path in a loop-like fashion below the paper currency reception/delivery port for allowing the replenishment/collection-destined paper currency storing unit to be additionally mounted, the paper currency reception/delivery machines according to the fourth to eighth embodiments of the invention can be realized as the automatic cash transaction apparatus which can effectuate the replenishment, collection and detailed check for the paper currencies.

Further, in the paper currency reception/delivery machines according to the second to eighth embodiments of the invention, the total number of the individual storing units as well as the number of combinations thereof can be changed as desired, to thereby realize the structure imparted with high degree of general-purpose utility in respect to practical applications and handling of the paper currencies.

The paper currency reception/delivery machine according to the fifth to eight embodiments of the invention is so implemented that the storing unit assembly and the other portion of the paper currency reception/delivery machine can be divided in the vertical direction. Accordingly, when the cash storing unit assembly or block is to be enclosed with a harder housing for the anti-holdup purpose, then it will be sufficient to reinforce only the lower cash storing unit block.

In all of the paper currency reception/delivery machines described above, the temporary custody unit 4 is incorporated for storing or retaining once the received paper currencies. However, in the paper currency reception/delivery machine which is not equipped with the temporary custody unit, such arrangement can be adopted that the received paper currencies are stored directly in the recycling-destined paper currency storing unit 8 in dependence on the results of the checks performed by the received paper currency check unit 3 and when customer cancels the deposit and demands return of the paper currencies once received by the machine, then the corresponding amount of paper currencies is fed out from the recycling-destined paper currency storing unit 8 for delivery to the customer. In this way, the automatic cash transaction apparatus equipped with no temporary custody unit can perform the monetary transactions similarly to those incorporating the temporary custody unit.

Accordingly, all suitable modifications and equivalents may be resorted to, falling within the spirit and scope of the invention.

As is apparent from the foregoing description, it is possible according to the teachings of the present invention to change not only the numbers of the paper currency storing units such as received paper currency storing unit, the delivery-destined paper currency storing unit, the recycling-destined paper currency storing unit, the rejection-destined paper currency storing unit and the replenishment/collection-destined paper currency storing unit individually but also a total number of these storing unit.

Further, owing to the feature that the paper currency check units and the temporary custody unit may be selectively incorporated or spared as occasion requires, there is provided the paper currency reception/delivery machine which can cope with a very wide variety of monetary transactions and which can thus enjoy high general-purpose utility. By way of example, the paper currency reception/delivery machine can easily be selectively reconfigured so as to serve as the paper-currency receiving machine only for the deposit transaction or a paper-currency delivering machine only for the payment transaction or a paper currency reception/delivery machine for dealing with both the deposit and payment transactions. Besides, the paper currency reception/delivery machine can easily cope with the selection of the number of denominations allowed for the monetary transactions as well as the denominations of the paper currencies to be recycled.

Furthermore, according to the teachings of the invention, there is provided the paper currency reception/delivery machine which can be implemented in a simple structure in a small size at low cost owing to the capability of selecting a minimum number of component units required for realizing the functions imposed.

Additionally, the paper currency reception/delivery machine according to the invention can ensure enhanced manipulatability of the storing units or safe units and transport paths for the person in charge of service or maintenance person upon occurrence of abnormality such as jamming of the paper currencies, etc..

Besides, the paper currency reception/delivery machine according to the invention is capable of handling not only the paper currencies of Japanese yens but also foreign paper currencies of different sizes.

Finally, it should also be mentioned that by virtue of incorporation of plural recycling-destined paper currency storing units and replenishment/collection-destined paper currency storing unit, burden imposed on the person in charge of service for replenishment of the paper currencies, collection and the detailed check of the amount in hand can be significantly reduced.

What is claimed is:

1. A leaflets handling apparatus including checking means for checking leaflets and transport path means for transporting leaflets passed through said checking means, comprising:

port means for receiving or delivering said leaflets;

a temporary custody unit for holding temporarily the leaflets received from said port means;

a plurality of leaflet storing units for storing said leaflets; and a controller unit for controlling said leaflets handling apparatus;

said transport path means including a main transport path for transporting the leaflets in one direction by way of said checking means;

said main transport path connecting in a loop in an order of said port means, said checking means, said temporary custody unit, said plurality of leaflet storing units and said port means;

wherein the leaflets fed out from said port means or from a given one of said leaflet storing units are transferred to said main transport path by way of branch transport paths provided independently and merged to said main transport path;

wherein the leaflets to be fed to said-port means or the leaflets to be stored in a given one of said leaflet storing units are collected by tapping from at least one relevant branching location provided independent of said main transport path; and wherein said temporary custody unit temporarily holds the leaflets from said port means and transports the leaflets into said main transport path after a deposit transaction for receiving the leaflets from said port means has been completed.

2. A leaflets handling apparatus according to claim 1, wherein said main transport path transports the leaflets in one direction from leaflet feeding means provided in association with said port means back to leaflet stacking means provided in association with said port means, said main transport path being divided into an upstream, transport path extending from said port means to said temporary custody unit and a downstream transport path extending from said temporary custody unit to said port means;

wherein merging locations through which the leaflets are transferred to said main transport path or branching locations through which the leaflets are transferred from said main transport path are provided in said downstream transport path;

wherein said controller unit stores denomination information of respective leaflets which are temporarily held in the temporary custody unit; and wherein said controller unit controls transport of the leaflets into respective ones of said plurality of leaflet storing units corresponding to the denomination information stored in said controller unit.

3. A leaflets handling apparatus according to claim 2, further comprising:

driving means for driving temporary custody unit for holding temporarily the leaflets received through said port means, said upstream transport path and said downstream transport path independent of one another;

wherein said controller unit controls said driving means to execute leaflet transport operation of said upstream transport path and said downstream transport path independent of each other; and wherein said controller unit controls so that the leaflets transported from said port means and decided to be normal by said checking means are placed within said temporary custody unit while the leaflets decided to be rejected by said checking means are held on said downstream transport path by driving or stopping said driving means.

4. A leaflets handling apparatus according to claim 1, wherein said controller unit controls said temporary custody unit; and wherein said temporary custody unit is realized to be reversibly rotatable in forward and backward directions selectively for storing the leaflets fed thereto in a sequence in which the leaflets are fed to said temporary custody unit when said temporary custody unit is rotated in the forward direction while the leaflets are fed out onto said transport path in a sequence reverse to said sequence when said temporary custody unit is rotated in the backward direction.

5. A leaflets handling apparatus according to claim 1, wherein said plurality of leaflet storing units can be disposed selectively in arbitrarily changeable combinations.

6. A leaflets handling apparatus according to claim 1, wherein said plurality of leaflet storing units are disposed in a stack at a rear side of said leaflets handling apparatus whereas said port means and said temporary custody unit are disposed at a front side of said leaflets handling apparatus.

7. A leaflets handling apparatus according to claim 6, wherein said leaflet storing units are implemented to be arbitrarily changeable in respect to disposition thereof and removable from the rear side of said leaflets handling apparatus.

8. A leaflets handling apparatus according to claim 1, said leaflet storing units includes a recycle-destined paper currency leaflet storing unit for accommodating the leaflets transported from said port means and transporting the leaflets to said port means, and wherein said recycle-destined paper currency leaflet storing unit is so arranged as to receive the leaflets with bottom ends thereof being aligned while feeding out said leaflets onto said transport path by sandwiching bottom end portions thereof.

9. A leaflets handling apparatus according to claim 1, wherein said temporary custody unit temporarily holds identified leaflets therein.

10. A leaflets handling apparatus according to claim 9, wherein the identified leaflets are leaflets identified by said checking means.

11. A leaflets handling apparatus for handling leaflets and including checking means for checking said leaflets, comprising:

port means for receiving or delivering the leaflets;

a temporary custody unit for holding temporarily the leaflets received from said port means;

a plurality of leaflet storing units for storing the leaflets and being vertically arranged in said leaflets handling apparatus;

a main transport path for transporting the leaflets in one direction in a loop-like fashion so that the leaflets passed through said checking means return to said checking means; and said main transport path connecting in a loop in an order of said port means, said checking means, said temporary custody unit, said plurality of leaflet storing units and said port means;

wherein the leaflets fed in from said port means or fed out individually from said leaflet storing units are transferred to said main transport path from feeding means provided in association with said port means and said leaflet storing units, respectively, by associated transport paths and through associated merging locations, respectively, which are provided independent of one another while the leaflets are fed to said port means and said leaflet storing units individually from said main transport path through associated branching locations, respectively, which are provided independent of one another.

12. A leaflets handling apparatus according to claim 11, wherein said main transport path is so arranged that the leaflets having passed through said checking means can return to said checking means after passing through the branching/merging locations provided in association with said leaflet storing units and then passing through the branching/merging locations associated with said port means.

13. A leaflets handling apparatus according to claim 11, wherein said leaflet storing units are disposed at a rear side of said leaflets handling apparatus so as to be removable independent of one another.

14. A leaflets handling apparatus according to claim 11, wherein said temporary custody unit temporarily holds identified leaflets therein.

15. A leaflets handling apparatus according to claim 14, wherein the identified leaflets are leaflets identified by said checking means.

16. A leaflets handling apparatus, comprising:

port means for receiving or delivering leaflets;

checking means for checking the leaflets;

a transport path for transporting the leaflets by way of said checking means; and a plurality of leaflet storing units for storing the leaflets;

wherein said leaflet storing units can be disposed in an arbitrarily selected combination relative to said transport path and mounted removably so as to be correspondently exchangeable;

wherein said plurality of leaflet storing units include a received leaflet storing unit having a leaflet receipt function for holding leaflets received from said port means, a delivery leaflet storing unit having a leaflet delivery function for holding leaflets to be delivered to said port means, and a recycled leaflet storing unit having the leaflet receipt function, the leaflet delivery function and a function for recycling leaflets; and wherein said transport path is combined to at least one of said received leaflet storing unit, said delivery leaflet storing unit and said recycle leaflet storing unit.

17. A leaflets handling apparatus according to claim 16, wherein said leaflet storing units are disposed at a rear side of said leaflets handling apparatus, being stacked sequentially.

18. A leaflets handling apparatus, comprising:

port means for receiving or delivering leaflets;

checking means for checking the leaflets;

a temporary custody unit for storing temporarily the leaflets received through said port means; and a transport part for transporting the leaflets by way of said checking means;

wherein said temporary custody unit includes a guide tape and a rotatable drum, said rotatable drum being rotated in a direction of taking up said guide tape to take up the leaflets transported from said port means, said leaflets transported from said checking means being sequentially wound around said rotatable drum to be thereby retained within said temporary custody unit, and wherein upon successful completion of predetermined transaction, said rotatable drum is rotated reversely for allowing said wound leaflets to be fed out from said temporary custody unit onto said transport path.

19. A leaflets handling apparatus according to claim 18, further comprising:

leaflet storing units for storing the leaflets transported from said port means or the leaflets to be transported to said port means, wherein said leaflet storing units are disposed at a rear side of said leaflets handling apparatus while said port means and said temporary custody unit are disposed at a front side of said leaflets handling apparatus with said port means being positioned above said temporary custody unit.

20. A leaflets handling apparatus according to claim 18, wherein said temporary custody unit temporarily holds identified leaflets therein.

21. A leaflets handling apparatus according to claim 20, wherein the identified leaflets are leaflets identified by said checking means.

22. A leaflet handing apparatus for handling leaflets, comprising:

port means for receiving or delivering leaflets;

checking means for checking the leaflets;

first transporting means for transporting said leaflets by way of said checking means;

a plurality of leaflet storing units disposed relative to said first transporting means for storing therein the leaflets;

second transporting means interconnecting said first transporting means and said leaflet storing units independently for transporting the leaflets to said leaflet storing units; and a temporary custody unit for holding temporarily the leaflets transported from said port means, wherein said first transporting means includes upstream transporting means extending from said port means to said temporary custody unit by way of said checking means and downstream transporting means extending from said temporary custody unit to said port means;

wherein the leaflets transported from said port means and decided to be authentic by said checking means are retained temporarily at said temporary custody unit, while the leaflets decided to be rejected by said checking means are held by said downstream transporting means;

wherein said first transporting means is so arranged as to transport said leaflets loopwise in one direction so that the leaflets fed out from a given location can return to said given location; and wherein said first transporting means includes a plurality of transporting means which are driven independently by driving means.

23. A leaflets handling apparatus according to claim 22, wherein said temporary custody unit includes a rotatable member rotatable forwardly or reversely, said leaflets transferred from said first transporting means being sequentially stored by rotating forwardly said rotatable member, while said leaflets are fed out onto said first transporting means sequentially in reverse order by rotating reversely said rotatable member.

24. A leaflets handling apparatus according to claim 22, wherein said plurality of leaflet storing units are disposed, being stacked, at a rear side of said leaflets handling apparatus.

25. A leaflets handling apparatus according to claim 22, wherein said plurality of leaflet storing units have correspondent exchangeability.

26. A leaflets handling apparatus according to claim 22, wherein said temporary custody unit temporarily holds identified leaflets therein.

27. A leaflets handling apparatus according to claim 26, wherein the identified leaflets are leaflets identified by said checking means.

* * * * *